US009205968B2

(12) United States Patent
Zeng et al.

(10) Patent No.: US 9,205,968 B2
(45) Date of Patent: Dec. 8, 2015

(54) MULTIDIRECTIONAL FUSE SUSCEPTOR

(75) Inventors: Neilson Zeng, North York (CA); Laurence M. C. Lai, Mississauga (CA); Scott W. Middleton, Oshkosh, WI (US)

(73) Assignee: Graphic Packaging International, Inc., Atlanta, GA (US)

( * ) Notice: Subject to any disclaimer, the term of this patent is extended or adjusted under 35 U.S.C. 154(b) by 910 days.

(21) Appl. No.: 13/418,666

(22) Filed: Mar. 13, 2012

(65) Prior Publication Data

US 2012/0207885 A1 Aug. 16, 2012

Related U.S. Application Data

(63) Continuation-in-part of application No. 11/789,898, filed on Apr. 26, 2007, now Pat. No. 8,158,913.

(60) Provisional application No. 60/795,320, filed on Apr. 27, 2006, provisional application No. 60/890,037, filed on Feb. 15, 2007, provisional application No. 60/926,183, filed on Apr. 25, 2007.

(51) Int. Cl.
*H05B 6/80* (2006.01)
*B65D 81/34* (2006.01)

(52) U.S. Cl.
CPC ..... *B65D 81/3446* (2013.01); *B65D 2581/344* (2013.01); *B65D 2581/3467* (2013.01); *B65D 2581/3472* (2013.01); *B65D 2581/3487* (2013.01)

(58) Field of Classification Search
CPC ..... B65D 81/3446; B65D 2581/344; B65D 2581/3487; B65D 2581/3472; B65D 2581/3467
USPC ..... 219/730, 725, 728, 729, 734, 735, 759; 426/107, 109, 234, 241, 243; 99/DIG. 14
See application file for complete search history.

(56) References Cited

U.S. PATENT DOCUMENTS

| | | | |
|---|---|---|---|
| 4,283,427 | A | 8/1981 | Winters et al. |
| 4,775,771 | A | 10/1988 | Pawlowski |
| 4,865,921 | A | 9/1989 | Hollenberg |
| 4,890,439 | A | 1/1990 | Smart |

(Continued)

FOREIGN PATENT DOCUMENTS

WO WO 01/23275 A1 4/2001

OTHER PUBLICATIONS

International Search Report—PCT/US2007/010240, Apr. 26, 2007, Graphic Packaging International, Inc.

(Continued)

*Primary Examiner* — Quang Van
(74) *Attorney, Agent, or Firm* — Womble Carlyle Sandridge & Rice, LLP

(57) ABSTRACT

A microwave energy interactive structure includes microwave energy interactive material supported on a microwave energy transparent substrate, and a plurality of spaced apart microwave energy transparent segments circumscribed by the microwave energy interactive material. The plurality of spaced apart microwave energy transparent segments define a pattern of loops that may be dimensioned to induce resonance of microwave energy during microwave heating of a food item on the structure. The structure may also include a plurality of microwave energy transparent elements that are operative as fuses to prevent overheating of the structure.

45 Claims, 14 Drawing Sheets

(56) References Cited

U.S. PATENT DOCUMENTS

| | | | |
|---|---|---|---|
| 4,936,935 | A | 6/1990 | Beckett |
| 4,943,456 | A | 7/1990 | Pollart et al. |
| 4,963,424 | A | 10/1990 | Beckett |
| 5,002,826 | A | 3/1991 | Pollart et al. |
| 5,039,364 | A | 8/1991 | Beckett et al. |
| 5,117,078 | A | 5/1992 | Beckett |
| 5,118,747 | A | 6/1992 | Pollart et al. |
| 5,213,902 | A | 5/1993 | Beckett |
| 5,221,419 | A | 6/1993 | Beckett |
| 5,260,537 | A | 11/1993 | Beckett |
| 5,266,386 | A | 11/1993 | Beckett |
| RE34,683 | E | 8/1994 | Maynard |
| 5,340,436 | A | 8/1994 | Beckett |
| 5,354,973 | A | 10/1994 | Beckett |
| 5,410,135 | A | 4/1995 | Pollart |
| 5,412,187 | A | 5/1995 | Walters |
| 5,424,517 | A | 6/1995 | Habeger |
| 5,446,270 | A | 8/1995 | Chamberlain |
| 5,489,766 | A | 2/1996 | Walters |
| 5,519,195 | A | 5/1996 | Keefer |
| 5,530,231 | A | 6/1996 | Walters |
| 5,628,921 | A | 5/1997 | Beckett |
| 5,672,407 | A | 9/1997 | Beckett |
| 5,759,422 | A | 6/1998 | Schmelzer |
| 5,800,724 | A | 9/1998 | Habeger |
| 6,114,679 | A | 9/2000 | Lai |
| 6,133,560 | A | 10/2000 | Zeng et al. |
| 6,150,646 | A | 11/2000 | Lai et al. |
| 6,204,492 | B1 | 3/2001 | Zeng et al. |
| 6,251,451 | B1 | 6/2001 | Zeng |
| 6,414,290 | B1 | 7/2002 | Cole |
| 6,433,322 | B2 | 8/2002 | Zeng et al. |
| 6,455,827 | B2 | 9/2002 | Zeng |
| 6,501,059 | B1 | 12/2002 | Mast |
| 6,552,315 | B2 | 4/2003 | Zeng et al. |
| 6,677,563 | B2 | 1/2004 | Lai |
| 6,717,121 | B2 | 4/2004 | Zeng |
| 6,765,182 | B2 | 7/2004 | Cole |
| 2001/0017297 | A1* | 8/2001 | Zeng et al. ..... 219/730 |
| 2010/0213192 | A1 | 8/2010 | Middleton et al. |

OTHER PUBLICATIONS

Written Opinion—PCT/US2007/010240, Apr. 26, 2007, Graphic Packaging International, Inc.

* cited by examiner

MULTIDIRECTIONAL FUSE SUSCEPTOR

CROSS-REFERENCE TO RELATED APPLICATIONS

This application is a continuation-in-part of U.S. patent application Ser. No. 11/789,898, filed Apr. 26, 2007, which claims the benefit of U.S. Provisional Application No. 60/795,320, filed Apr. 27, 2006, U.S. Provisional Application No. 60/890,037, filed Feb. 15, 2007, and U.S. Provisional Application No. 60/926,183, filed Apr. 25, 2007, all of which are incorporated by reference herein in their entirety.

TECHNICAL FIELD

The present invention relates generally to microwave energy interactive structures and, more particularly, to microwave energy interactive structures that are capable of heating, browning, and/or crisping an adjacent food item.

BACKGROUND

The use of susceptors in food packaging for microwavable food items is well known to those in the art. The susceptor is operative for converting microwave energy into thermal energy (i.e., heat), which then can be transferred to an adjacent food item. As a result, the heating, browning, and/or crisping of the food item can be enhanced. With a conventional plain susceptor film, there is a random flow of current under microwave energy radiation. The magnitude of the current flow depends on the surface resistance of the susceptor, which is related to the random distribution of fine metallic spots and the E-field strength applied to the sheet. If the magnitude of the current is high enough, or a susceptor is used in a package without a uniform food load, the susceptor film may overheat at one or more regions and cause crazing or shrinking of the susceptor film. As a result, the ability of the susceptor to generate heat is diminished. Thus, there is a need for a microwave energy interactive structure that enhances heating, browning, and/or crisping of an adjacent food item while being resistant to burning, crazing, and scorching.

SUMMARY

A microwave energy interactive structure (e.g., a susceptor structure) including a layer of microwave energy interactive material that is generally operative for converting microwave energy into heat is provided with a plurality of microwave energy inactive or transparent areas that reduce or prevent large scale random current flow within the microwave energy interactive material. The microwave energy transparent areas are arranged as a pattern of segments that define a plurality of generally interconnected shapes. In one exemplary embodiment, a microwave energy transparent element or area is substantially centrally located within each shape.

In one aspect, the interconnected shapes are dimensioned to create a resonant effect in the presence of microwave energy. The resonant effect of the interconnected shapes provides uniform power distribution and, therefore, uniform heating, across the structure.

In another aspect, the interconnected shapes form a "multidirectional fuse". The multidirectional fuse includes a plurality of selectively arranged microwave energy transparent areas that limit the random flow of current and random crazing typically observed with conventional susceptor structures.

As a result of these and other aspects, the susceptor structure is less susceptible to crazing, and therefore, is less susceptible to premature failure. As such, the susceptor structure can withstand higher power levels and has a greater useful life, while still having an innate ability to self-limit or "shut down" to avoid undesirable overheating.

In one example, the microwave energy interactive structure comprises microwave energy interactive material supported on a microwave energy transparent substrate, and a plurality of microwave energy transparent segments circumscribed by the microwave energy interactive material. The plurality of spaced apart microwave energy transparent segments defines a pattern of interconnected hexagonal loops. A plurality of the interconnected hexagonal loops defines a resonant loop having a total peripheral length approximately equal to the wavelength of microwave energy in an operating microwave oven. The plurality of microwave energy transparent segments may further define a plurality of cross-shaped elements, which may be substantially centered within the interconnected hexagonal loops.

In another example, the microwave energy interactive structure comprises microwave energy interactive material supported on a microwave energy transparent substrate, and a plurality of microwave energy transparent areas within the microwave energy interactive material. The plurality of microwave energy transparent areas defines a pattern of interconnected loops and microwave energy transparent areas disposed within the interconnected loops. A plurality of the interconnected loops define a resonant loop having a total peripheral length approximately equal to the wavelength of microwave energy in an operating microwave oven.

In still another example, the microwave energy interactive structure comprises an electrically continuous layer of microwave energy interactive material supported on a microwave energy transparent substrate, and a repeating pattern of microwave energy transparent areas within the layer of conductive material. The repeating pattern of microwave energy transparent areas includes interconnected segmented hexagonal loops and cross-shaped elements, where the cross-shaped microwave elements are each disposed within a respective one of the interconnected segmented hexagonal loops. The interconnected segmented hexagonal loops each have a first peripheral length, where the peripheral length is approximately equal to one-half of an effective wavelength of microwaves in an operating microwave oven. A plurality of the interconnected segmented hexagonal loops define a resonant loop having a total peripheral length, where the total peripheral length is approximately equal to the effective wavelength of microwave energy in the operating microwave oven.

In these and other examples, the total peripheral length of the resonant loop may be from about 10 cm to about 12 cm. Further, the interconnected loops defining the resonant loop have any suitable configuration. In some embodiments, the loops may be arranged in a clustered configuration, in a linear configuration, or in any other suitable configuration. The loops may be hexagonal in shape or any other suitable shape.

Other features, aspects, and embodiments will be apparent from the following description and accompanying figures.

BRIEF DESCRIPTION OF THE DRAWINGS

The description refers to the accompanying drawings, some of which are schematic, in which like reference characters refer to like parts throughout the several views, and in which.

DETAILED DESCRIPTION

The present invention may be illustrated further by referring to the figures. For purposes of simplicity, like numerals may be used to describe like features. It will be understood that where a plurality of similar features are depicted, not all of such features necessarily are labeled on each figure. It also will be understood that various components used to form the microwave energy interactive structures of the invention may be interchanged. Thus, while only certain combinations are illustrated herein, numerous other combinations and configurations are contemplated hereby.

Figure 1A:
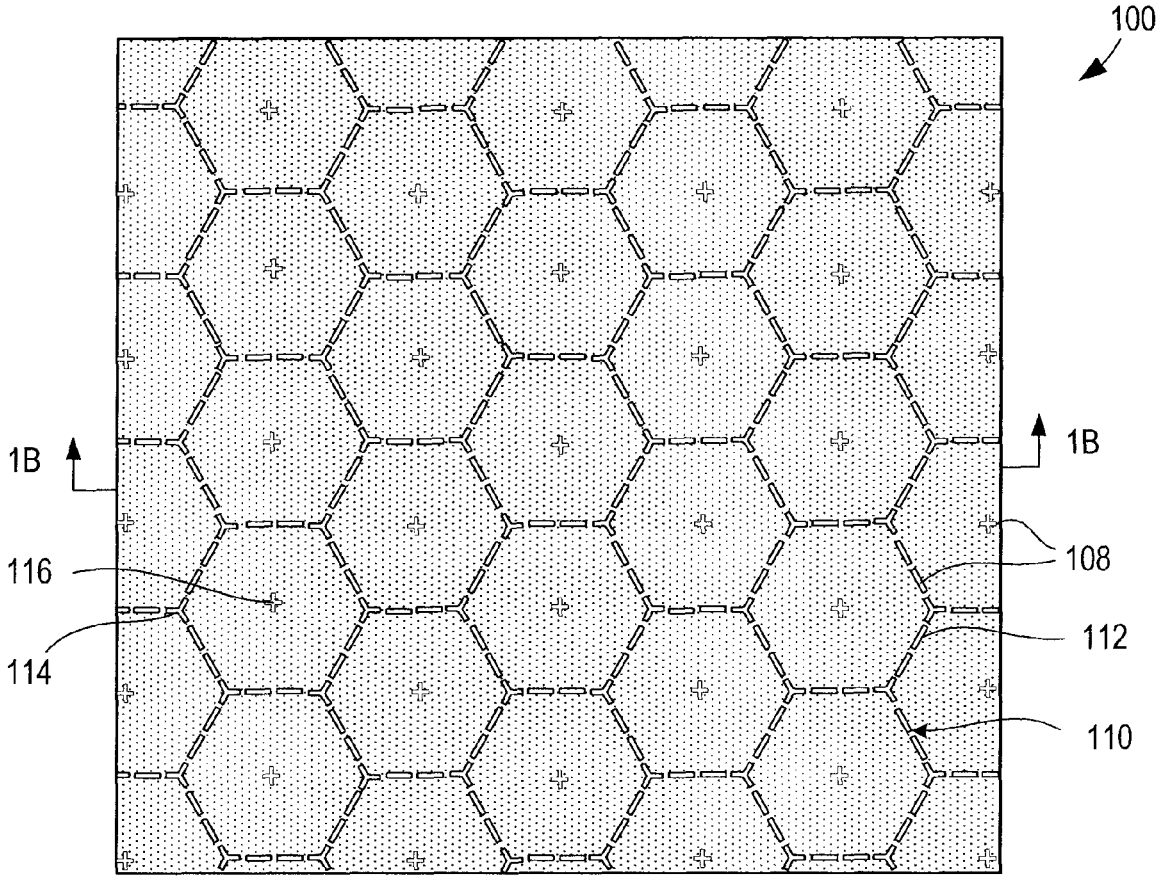
FIG. 1A schematically depicts an exemplary microwave energy interactive structure according to various aspects of the invention.
Figure 1B:
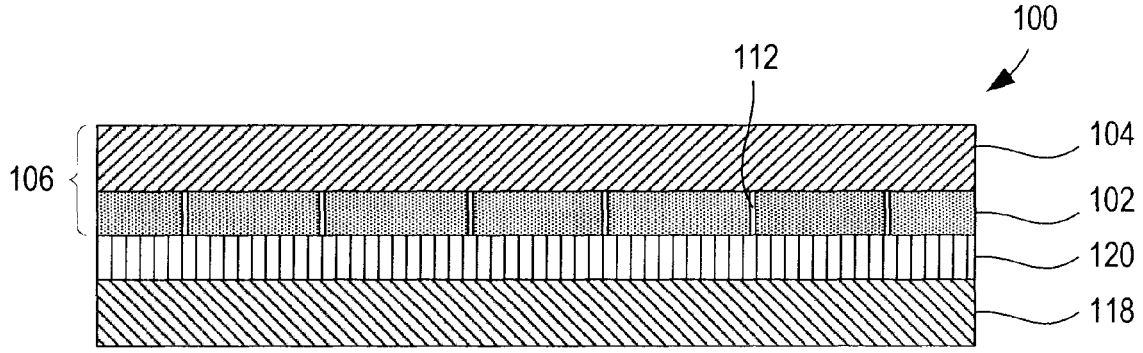
FIG. 1B schematically depicts a cross-sectional view of the structure of FIG. 1A taken along a line 1B-1B.

FIGS. 1A and 1B illustrate an exemplary microwave energy interactive structure 100. The structure 100 includes a layer of microwave energy interactive material 102 (schematically illustrated with stippling). The layer of microwave energy interactive material may be sufficiently thin (e.g., generally less than about 100 angstroms in thickness, for example, from about 60 to about 100 angstroms in thickness, and having an optical density of from about 0.15 to about 0.35, for example, about 0.17 to about 0.28), so that the microwave energy interactive material is operative as a susceptor, which is generally operative for converting at least a portion of impinging microwave energy into thermal energy (i.e., heat) that can be transferred to an adjacent food item. The microwave energy interactive material or susceptor 102 may be deposited or supported on a microwave energy transparent substrate 104 (e.g., a polymer film) for ease of handling and/or to prevent contact between the microwave interactive material and a food item (not shown). The microwave energy interactive material 102 and polymer film substrate 104 collectively define a susceptor film 106, which may be joined to a dimensionally stable support 118, for example, paper, using a layer of adhesive 120 or otherwise, as will be discussed further below.

As shown in FIGS. 1A and 1B, the structure 100 includes a plurality of microwave energy inactive or transparent elements or segments (generally "areas") 108 (shown in white) within the layer of microwave energy interactive material 102 (shown with stippling). The microwave energy interactive material 102 is generally continuous except where interrupted by the microwave transparent areas 108, shown in white. Each transparent or inactive area may be a portion of the structure from which microwave energy interactive material has been removed chemically or otherwise, may be a portion of the structure formed without a microwave energy interactive material, or may be a portion of the structure formed with a microwave energy interactive material that has been deactivated chemically, mechanically, or otherwise. Each transparent or inactive area is circumscribed (i.e., surrounded) by the microwave energy interactive material (except those segments that abut an edge of the structure). Thus, the layer of microwave energy interactive material 102 is electrically continuous.

Some of the microwave energy transparent areas 108 are arranged to form a plurality of interconnected, segmented loops 110. By "interconnected", it is meant that the loops 110 share one or more sides with adjacent loops. In this example, the segmented loops 110 are substantially hexagonal in shape. However, other shapes, for example, circles, squares, rectangles, pentagons, heptagons, or any other regular or irregular shape may be suitable.

Figure 1C:
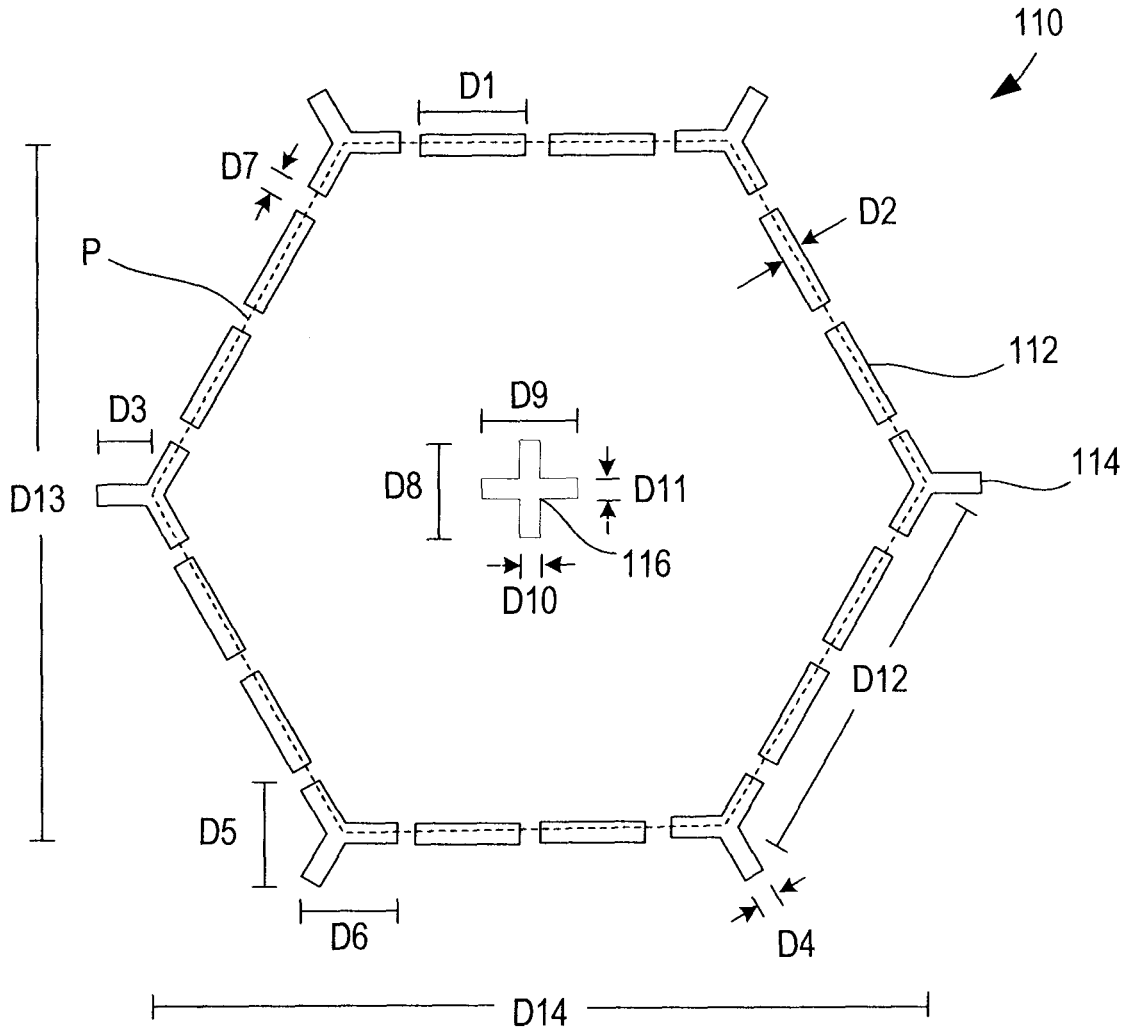
FIG. 1C schematically depicts a segmented loop according to various aspects of the invention.

As best seen in FIG. 1C, each hexagonal loop 110 is formed from a plurality of microwave energy transparent side elements or segments ("side elements" or "side segments") 112 and microwave energy transparent corner elements or segments ("corner elements" or "corner segments") 114. More particularly, each hexagonal loop 110 is formed from 6 pairs of side segments 112 (12 side segments total) and 6 corner segments 114, with the pairs of side segments 112 and corner segments 114 alternating along the loop 110. However, other configurations are contemplated. For example, the hexagonal loops 110 may be formed from 6 side segments and 6 corner segments, 9 side segments and 6 corner segments, 12 side segments and 6 corner segments, or any other number and arrangement of elements. The combination of side segments 112, corner segments 114, and the microwave energy interactive areas therebetween defines a perimeter or peripheral length P (shown with dashed lines) of each loop 110.

In this example, the side segments 112 are substantially rectangular in shape. Each side segment 112 has a first dimension D1 and a second dimension D2, for example, a length and a width. The corner segments 114 resemble a trio of overlapping substantially rectangular areas or segments, and are referred to herein as having a "tri-star" shape. However, other shapes are contemplated hereby. Each of the three "arms" that form the corner segments 114 has a first dimension D3 and a second dimension D4, for example, a length and a width. The overall tri-star shape also has a first dimension D5 and a second dimension D6, for example, a length and a width. Each of the segments 112, 114 is separated from an adjacent segment 112, 114 a distance D7.

Additionally, the structure 100 includes a plurality of independent or "floating" microwave energy transparent elements, areas, or "islands" 116, each of which is disposed within one of the segmented loops 110 (except those islands that lie proximate an edge of the structure, which may be within or bordered by only a partial loop). In this example, the microwave energy transparent elements 116 are substantially cross-shaped. However, it will be understood that element 116 may be shaped as a circle, triangle, square, pentagon, hexagon, star, or any other regular or irregular shape.

The substantially cross-shaped element 116 may be considered to comprise two orthogonally arranged rectangular segments that overlap at their respective midpoints, or may be viewed as four rectangular "arms" overlapping at one end of each thereof. The overlapping rectangular segments or arms may have substantially the same dimensions or may differ from one another. In any case, each element 116 has a first overall dimension D8 and a second overall dimension D9, for example, a length and a width (either or both of which may correspond to the length of one of the rectangular segments), a third dimension D10, and a fourth dimension D11 corresponding to the respective width of each arm of the cross-shaped element 116. In this example, the microwave energy transparent element 116 is located substantially centrally within the hexagonal loop 110. However, other arrangements of loops and islands are contemplated hereby.

Each of the various loops also includes a side length D12, a side to side length ("minor length") D13, a diametrically opposed, corner to corner length ("major length") D14, and numerous other specifications that may be used to characterize the various susceptor structures of the invention.

In one aspect, the microwave energy inactive or transparent areas (e.g., segments or areas 112, 114) may be configured within the layer of microwave energy interactive material 102 to facilitate the distribution of power across the microwave energy interactive structure (e.g., structure 100), which thereby enhances at least one of the heating, browning, and crisping of an adjacent food item. More particularly, the loops (e.g., loops 110) may be dimensioned to induce resonance of microwave energy along each loop or groups of adjacent loops and/or across the array of loops. Such suitably dimensioned loops or groups of loops may be referred to as "resonant loops". During microwave heating, the flow of current along each resonant loop increases while the percentage of reflected microwave energy decreases. This, in turn, provides more uniform heating, browning, and/or crisping of the food item. Further, the enhanced power distribution across the structure also reduces the potential for overheating, crazing, or charring of the structure in any particular area.

In general, to induce resonance, the loops 110 may be dimensioned so that a total peripheral length of one or more interconnected loops (including both microwave energy transparent and the intervening microwave energy interactive areas as shown in FIG. 1C) is approximately equal to the effective wavelength of microwave energy in an operating microwave oven. In the case of a susceptor (e.g., susceptor 102), it has been found that the effective wavelength may be about 12 cm, as compared with the theoretical wavelength of 12.24 cm. Thus, in general, to induce resonance in a susceptor structure (e.g., structure 100), the total peripheral length of one or more interconnected loops may be about 12 cm.

Further, the peripheral length of each loop and the total peripheral length of the resonant loop can also be scaled to tune the resonance as needed for a particular food item and/or heating application. The resonant length is greatest at the free space wavelength (i.e., at the 12.24 cm), as the phase velocity of the wave is at its maximum (i.e., the speed of light). The presence of food in contact with the susceptor shortens the wavelength of microwave energy passing through the combination of food and susceptor. The more the medium can polarize in response to the applied field, the greater the dielectric constant, and the wavelength will decrease in inverse proportion to the square root of the dielectric constant. For foods, the dielectric constant will be highest when there is a high free water content for dipolar distortion (i.e., in the liquid state, not frozen) or high space charges (i.e., a high salt content). Thus, scaling the loop sizes appropriately, either larger or smaller for the specific food application, may further increase resonance along the loops. For many foods, a suitable total peripheral length may be from about 10 cm to about 12 cm, for example, 11 cm. However, other peripheral lengths may be suitable. It will be appreciated that the loops may be configured (e.g., sized, shaped, and arranged) in numerous ways to achieve the desired effect.

Figure 1D:
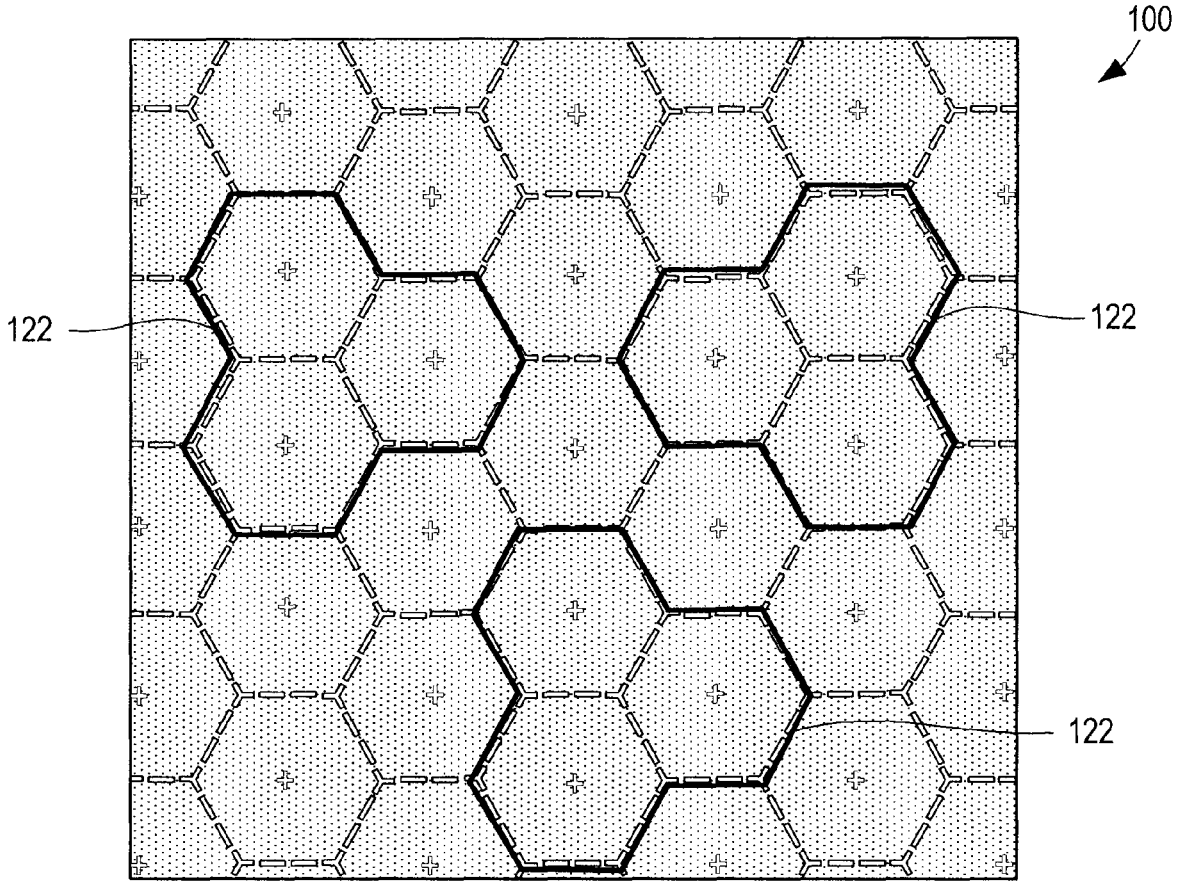
FIGS. 1D-1F schematically depict exemplary resonant loops of the microwave energy interactive structure of FIG. 1A.
Figure 1E:
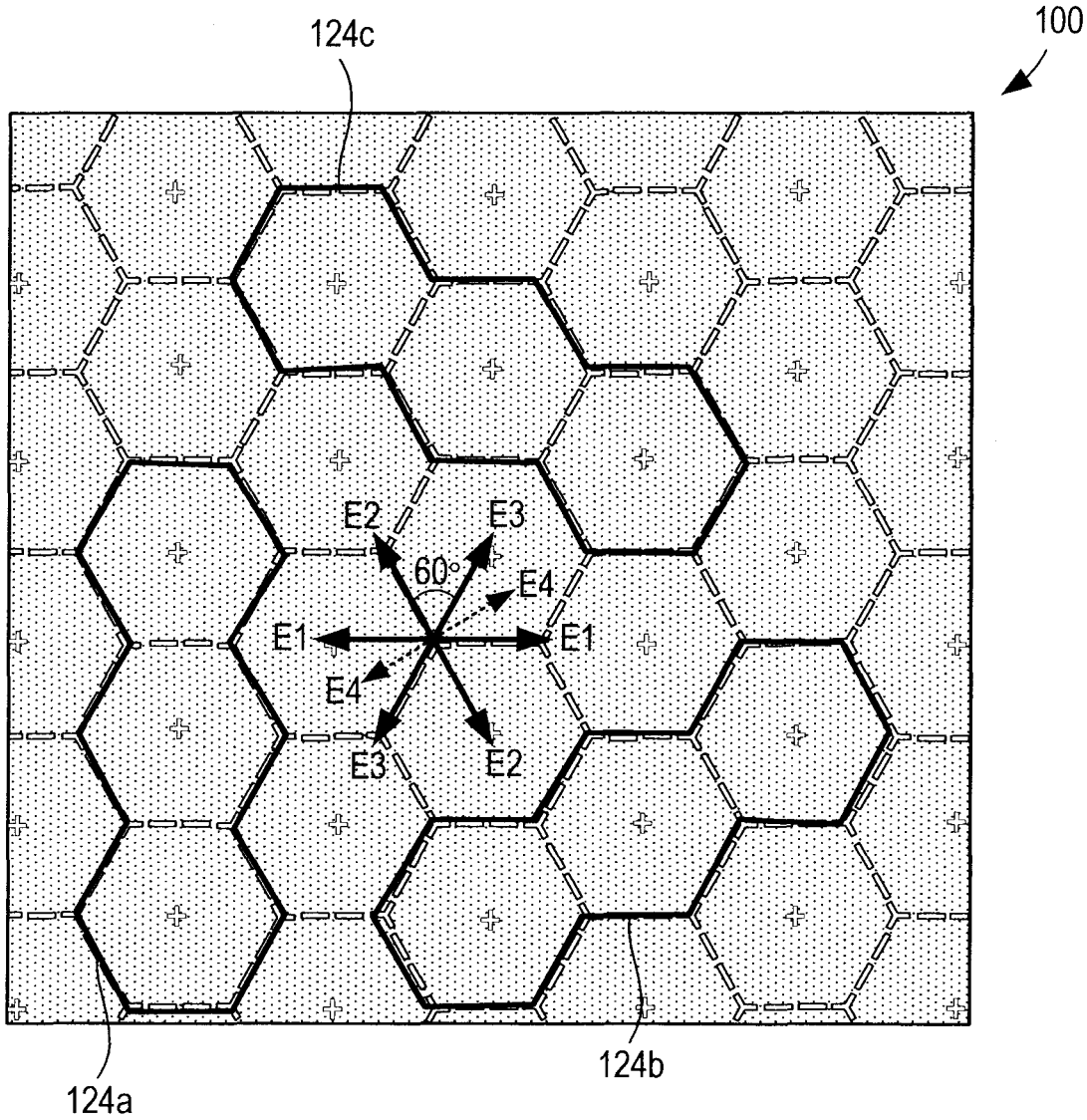

FIGS. 1D and 1E schematically illustrate various possible resonant loops that may be formed in the susceptor structure 100 of FIG. 1A. In both exemplary embodiments, a plurality of loops 110 (FIG. 1A) cooperate to define resonant loops having a total peripheral length of from about 10 cm to about 12 cm.

In the example shown in FIG. 1D, resonant loops 122 (only a few of which are labeled) each comprise three loops 110 (FIG. 1A) that are adjacent to and staggered with respect to one another in a cluster or clustered configuration. In such an example, the resonant loops 122 each have 12 sides or side edges, each of which may have a length of from about 0.8 cm to about 1 cm, so that the peripheral length of each loop of the resonant loop is from about 4.8 cm to about 6.0 cm, and each cluster of three adjacent loops has a total peripheral length of from about 10 cm to about 12 cm.

In the example shown FIG. 1E, resonant loops 124*a*, 124*b*, 124*c* (only a few of which are labeled) each include three loops 110 (FIG. 1A) arranged in a linear or side-by-side relationship, so that each resonant loop has 14 sides or side edges. Each side edge may be from about 0.71 cm to about 0.86 cm in length, so that the peripheral length of each loop of the resonant loop is from about 4.3 cm to about 5.2 cm, and the total peripheral length of the resonant loop is from about 10 cm to about 12 cm.

It will be noted that, while both of the above exemplary configurations of resonant loops may generally enhance heating across the susceptor structure, resonant loops 124*a*, 124*b*, 124*c* may provide increased resonance as compared with resonant loop 122. By way of explanation, and not limitation, consider a circular loop or element, which may generally approximate resonant loop 122. A circular element can interact with microwave energy from any angle, since some portion of the circle will always be aligned with the instantaneous field vector. Since the diameter of the circle is constant, the degree of resonance (typically quantified by its "Q factor", where the greater the Q factor, the greater the resonance) is also constant.

Consider now an elongate loop or element that resembles a compressed circle (e.g., an oval or obround having a major axis and a minor axis with different lengths), which may approximate the shape of resonant loops 124*a*, 124*b*, 124*c*. When such an element is aligned with the instantaneous field vector (so that the minor axis extends in the direction of the instantaneous field vector), the element exhibits an increased Q factor relative to a circular element because the capacitance increases across the narrower gap defined by the minor axis. As a result, a properly aligned elongate resonant loop (similar to loops 124*a*, 124*b*, 124*c*) will be more effective for enhancing the susceptor heating than a more circular loop (similar to loop 122).

Furthermore, resonant loops 124*a*, 124*b*, 124*c* of FIG. 1E can be re-configured and/or re-oriented in any manner in real time so that the resonant loops are substantially aligned with the instantaneous field vector (i.e., so that the major or lengthwise axis of the loop extends in a direction that is substantially perpendicular to the instantaneous field vector). For example, when the field vector is oriented in a direction E1, the resonant loop may be oriented like resonant loop 124*a*, when the field vector is oriented in a direction E2, the resonant loop may be oriented like resonant loop 124*b*, and when the field vector is oriented in a direction E3, the resonant loop may be oriented like resonant loop 124*c*. Thus, while any of resonant loops 124*a*, 124*b*, 124*c* may be present at any time, the lengthwise or major axis of at least one resonant loop will be no greater than 30° offset from the direction of the instantaneous field vector (e.g., E4) at any time. As a result, this configuration of resonant loops may impart significant and advantageous heating attributes to the susceptor structure.

Figure 1F:
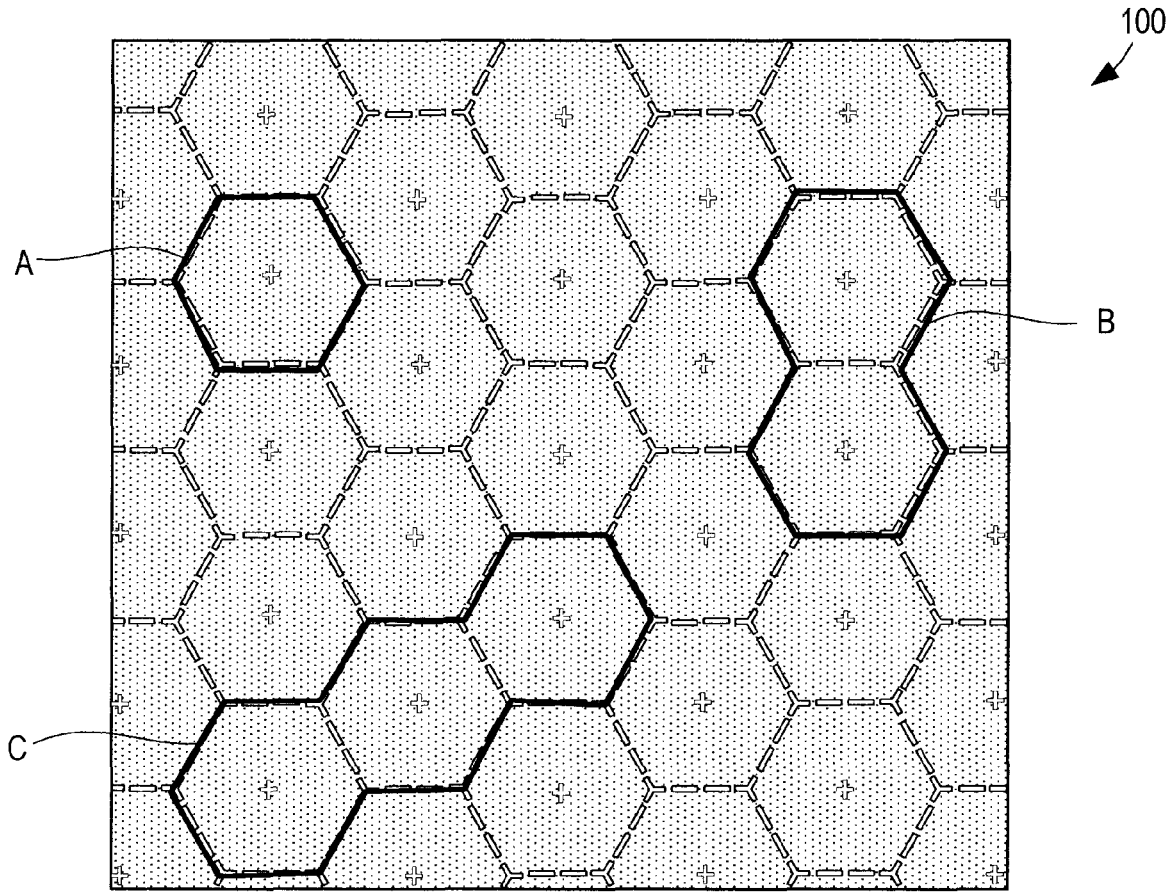

It will be appreciated that different loops, alone or in combination, may define resonant loops under different heating conditions. As the dielectric constant of the food item changes during heating (e.g., as a frozen food item thaws), so does the effective wavelength (the effective wavelength equals the theoretical wavelength divided by the square root of the effective dielectric constant of the food item). Accordingly, different loops and combinations of loops within a particular structure may define resonant loops during the heating cycle. By way of illustration and not limitation, FIG. 1F illustrates various loops or combinations of loops A, B, C. A given loop is resonant when its length is 1, 2, 3, . . . n wavelengths long. Assuming that each side of loop A has a length of about 1 cm, loop A may not be resonant at the free space wavelength of 12 cm, but would be resonant when the effective wavelength was about 6 cm, for example, when the effective dielectric constant of its environment was about 4.2, about 16.6, about 37.5, about 66.6, and so on, as set forth in Table 1. Loop B (e.g., having a total length of about 10 cm) may become resonant when the effective dielectric constant of the food item is about 1.5, about 6.0, about 13.5, about 24.0, and so on. Loop C (e.g., having a total length of about 12 cm) may become resonant when the effective dielectric constant of the food item is about 1.0, about 4.2, about 9.4, about 16.6, and so on. As the dielectric constant of the food item changes, different loops or combinations of loops A, B, and/or C may become resonant. Other numbers, combinations, and configurations of loops may define other resonant loops, depending on the dimensions of the loops and the properties of the food item being heated. Thus, the susceptor structure may be tailored to provide varying combinations of loops that are effective across a broad range of conditions experienced during the heating cycle.

TABLE 1

| | | Resonant conditions | | |
|---|---|---|---|---|
| Loop | Physical length (cm) | Number of wavelengths | Effective wavelength (cm) | Effective dielectric constant |
| A | 6 | 1 | 6.0 | 4.2 |
| | | 2 | 3.0 | 16.6 |
| | | 3 | 2.0 | 37.5 |
| | | 4 | 1.5 | 66.6 |
| B | 10 | 1 | 10.0 | 1.5 |
| | | 2 | 5.0 | 6.0 |
| | | 3 | 3.3 | 13.5 |
| | | 4 | 2.5 | 24.0 |
| C | 12 | 1 | 12.0 | 1.0 |
| | | 2 | 6.0 | 4.2 |
| | | 3 | 4.0 | 9.4 |
| | | 4 | 3.0 | 16.6 |

Figure 1G:
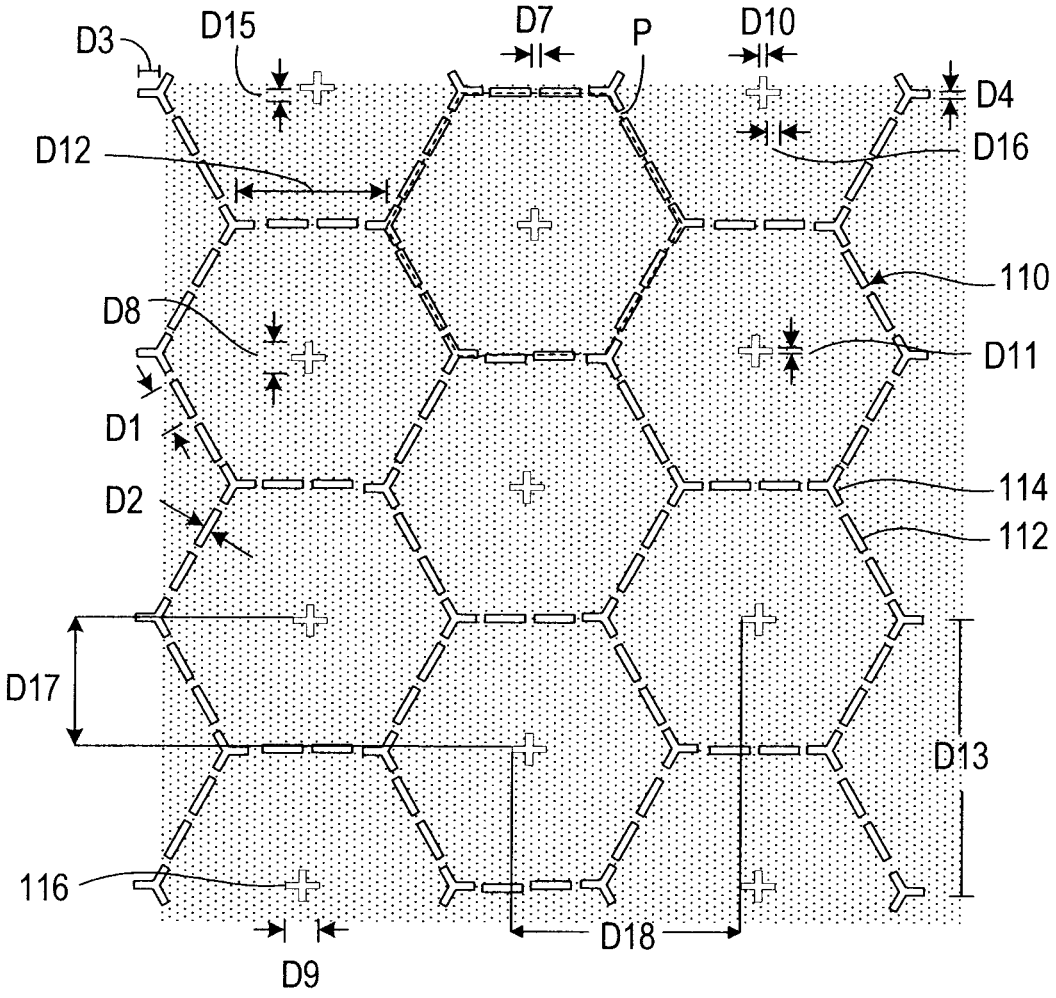
FIG. 1G schematically depicts an enlarged view of the arrangement of microwave energy interactive and transparent elements of FIG. 1A, with exemplary dimensions.

FIG. 1G provides exemplary dimensions for a segmented hexagonal loop 110 as illustrated in FIG. 1A. Each side segment 112 may have a first dimension, for example, a length D1, of about 2 mm and a second dimension, for example, a width D2, of about 0.5 mm. Each "arm" of the tri-star corner segment 114 may have a length D3 of about 1.5 mm and a width D4 of about 0.5 mm. The spacing D7 between each side segment 112 and between each rectangular segment 112 and corner segment 114 may be about 1 mm. The overall perimeter P of each segmented or broken hexagonal loop 110 may be about 60 mm. Each rectangular segment that forms the cross may have a respective length D8 or D9 of about 2 mm and a respective width D10 or D11 of about 0.5 mm. The cross-shaped element 116 may have an overall first dimension D8 of about 2 mm and an overall second dimension D9 of about 2 mm. The side length D12 may be about 10 mm and the side to side length ("minor length") D13 may be about 17.8 mm. Dimension D15 may be about 0.75 mm, D16 may be about 0.75 mm, D17 may be about 8.9 mm, and D18 may be about 15.4 mm. However, it will be understood that the various dimensions that define a particular susceptor structure may vary for each application. As such, numerous other dimensions and ranges of dimensions are contemplated hereby.

In each of various examples, dimensions D1, D2, D3, D4, D5, D6, D7, D8, D9, D10, and D11 may have any suitable value or may fall within a range of suitable values. More particularly, the side segments 112, corner segments 114, and microwave energy transparent islands or elements each may independently have respective dimensions D1, D2, D3, D4, D5, D6, D7, D8, D9, D10, D11, D15, and/or D16 of from about 0.1 to about 5 mm, from about 0.2 to about 3 mm, from 0.25 to about 0.75 mm, from about 0.3 to about 2.6 mm, from about 0.4 to about 2.5 mm, from about 0.4 to about 0.6, from about 0.5 to 2 mm, from about 0.8 to about 2.2 mm, or from about 1.75 to about 2.25 mm.

Still more particularly, in each of various examples, the various dimensions D1, D2, D3, D4, D5, D6, D7, D8, D9, D10, D11, D15, and/or D16 each independently may be about 0.1 mm, about 0.15 mm, about 0.2 mm, about 0.25 mm, about 0.3 mm, about 0.35 mm, about 0.4 mm, about 0.45 mm, about 0.5 mm, about 0.55 mm, about 0.6 mm, about 0.65 mm, about 0.7 mm, about 0.75 mm, about 0.8 mm, about 0.85 mm, about 0.9 mm, about 0.95 mm, about 1 mm, about 1.05 mm, about 1.1 mm, about 1.15 mm, about 1.2 mm, about 1.25 mm, about 1.3 mm, about 1.35 mm, about 1.4 mm, about 1.45 mm, about 1.5 mm, about 1.55 mm, about 1.6 mm, about 1.65 mm, about 1.7 mm, about 1.75 mm, about 1.8 mm, about 1.85 mm, about 1.9 mm, about 1.95 mm, about 2 mm, about 2.05 mm, about 2.1 mm, about 2.15 mm, about 2.2 mm, about 2.25 mm, about 2.3 mm, about 2.35 mm, about 2.4 mm, about 2.45 mm, about 2.5 mm, about 2.55 mm, about 2.6 mm, about 2.65 mm, about 2.7 mm, about 2.75 mm, about 2.8 mm, about 2.85 mm, about 2.9 mm, about 2.95 mm, or about 3 mm. Other values and ranges of values are contemplated hereby.

Likewise, in each of various examples, dimensions D12, D13, D14, D17, and D18 may have any suitable value or may fall within a range of suitable values. More particularly, in each of various examples, D12, D13, D14, D17, and/or D18 each independently may be from about 5 to about 25 mm, from about 10 to about 20 mm, from about 12 to about 15 mm, from about 5 to about 10 mm, from about 10 to about 15 mm, from about 15 to about 20 mm, or from about 20 to about 25 mm.

Still more particularly, in each of various examples, the various dimensions D12, D13, D17, and/or D18 each independently may be about 5 mm, about 5.5 mm, about 6 mm, about 6.5 mm, about 7 mm, about 7.5 mm, about 8 mm, about 8.5 mm, about 9 mm, about 9.5 mm, about 10 mm, about 10.5 mm, about 11 mm, about 11.5 mm, about 12 mm, about 12.5 mm, about 13 mm, about 13.5 mm, about 14 mm, about 14.5 mm, about 15 mm, about 15.5 mm, about 16 mm, about 16.5 mm, about 17 mm, about 17.5 mm, about 18 mm, about 18.5 mm, about 19 mm, about 19.5 mm, about 20 mm, about 20.5 mm, about 21 mm, about 21.5 mm, about 22 mm, about 22.5 mm, about 23 mm, about 23.5 mm, about 24 mm, about 24.5 mm, or about 25 mm.

In another aspect, the arrangement of microwave energy inactive or transparent areas 108 may control the propagation of any cracks or crazing caused by localized overheating within the structure 100. The microwave energy inactive loops 110 and crosses 116 positioned at various respective angles to one another work in concert as a "multidirectional fuse" to manage, control, and terminate the propagation of current, and therefore crazing, between the inactive areas. The multidirectional arrangement of inactive areas therefore provides controlled, directional voltage breakage or interruption, rather than random voltage breakage or interruption, thereby resulting in better protection of the structure. In a structure without the hexagonal loops, such as that shown in U.S. Pat. Nos. 5,412,187 and 5,530,231, the crosses can provide only limited, bidirectional protection against crazing of the susceptor.

The arrangement of microwave energy interactive material (e.g., susceptor 102) and microwave energy transparent areas (e.g., areas 112, 114, 116) can also be selected to provide various levels of heating, as needed or desired for a particular application. For example, where greater heating is desired, the substantially rectangular inactive areas could be made to be wider. In doing so, more microwave energy is transmitted to the food item. Alternatively, by narrowing the substantially rectangular areas, more microwave energy is absorbed, converted into thermal energy, and transmitted to the surface of the food item to enhance browning and/or crisping. Numerous other arrangements and configurations are contemplated hereby.

The microwave energy interactive material may comprise an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material where needed. Another metal oxide that may be suitable for use is indium tin oxide (ITO). ITO has a more uniform crystal structure and, therefore, is clear at most coating thicknesses. Alternatively, the microwave energy interactive material may comprise a suitable electroconductive, semiconductive, or non-conductive artificial dielectric or ferroelectric. Artificial dielectrics comprise conductive, subdivided material in a polymer or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

As stated above, the microwave energy interactive material (e.g., microwave energy interactive material 102) may be supported on a polymer film (e.g., polymer film 104). The thickness of the film typically may be from about 35 gauge to about 10 mil, for example, from about 40 to about 80 gauge, for example, from about 45 to about 50 gauge, for example, about 48 gauge. Examples of polymer films that may be suitable include, but are not limited to, polyolefins, polyesters, polyamides, polyimides, polysulfones, polyether ketones, cellophanes, or any combination thereof. In one specific example, the polymer film may comprise polyethylene terephthalate (PET). Examples of PET films that may be suitable include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.). The polymer film may be selected to impart various properties to the microwave interactive web, for example, printability, heat resistance, or any other property. As one particular example, the polymer film may be selected to provide a water barrier, oxygen barrier, or any combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

If desired, the polymer film may undergo one or more treatments to modify the surface prior to depositing the microwave energy interactive material onto the polymer film. By way of example, and not limitation, the polymer film may undergo a plasma treatment to modify the roughness of the surface of the polymer film. While not wishing to be bound by theory, it is believed that such surface treatments may provide a more uniform surface for receiving the microwave energy interactive material, which in turn, may increase the heat flux and maximum temperature of the resulting susceptor structure. Such treatments are discussed in U.S. Patent Application Publication No. 2010/0213192 A1, published Aug. 26, 2010, which is incorporated by reference herein in its entirety.

Other non-conducting substrate materials such as metal oxides, silicates, cellulosics, or any combination thereof, also may be used.

As stated previously, the susceptor film 106 may be joined at least partially to the dimensionally stable support 118 using a continuous or discontinuous layer adhesive or other suitable material 120 (shown as continuous in FIG. 1B). If desired, all or a portion of the support may be formed at least partially from a paperboard material having a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

Where a more flexible construct is to be formed, the support 118 may comprise a paper or paper-based material generally having a basis weight of from about 15 to about 60 lbs/ream, for example, from about 20 to about 40 lbs/ream. In one particular example, the paper has a basis weight of about 25 lbs/ream.

As stated above, the susceptor 106 may be joined to the support 118 in any manner and using any suitable material, for example, using a binding layer or adhesive 120. In one example, the layers are joined using a layer of a polyolefin, for example, polypropylene, polyethylene, low density polyethylene, or any other polymer or combination of polymers. However, other adhesives or adhesive materials are contemplated hereby. The adhesive material may have a basis weight or dry coat weight of from about 3 to about 18 lb/ream, for example, from about 5 to about 15 lb/ream. In another example, the adhesive material may have a dry coat weight of from about 8 to about 12 lb/ream.

It will be understood that with some combinations of materials, the microwave interactive element, for example, element 102, may have a grey or silver color that is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

The present invention may be understood further by way of the following examples, which are not intended to be limiting in any manner.

Test Procedures

Low power RAT: Each sample evaluated for low power RAT was placed into an HP8753A Network Analyzer. The output is used to calculate the reflection (R), absorption (A), and transmission (T) (collectively "RAT") characteristics of the sample. A merit factor then can be calculated as follows:

$$\text{Merit factor(MF)}=A/(1-R).$$

A higher MF generally means that the susceptor will convert more microwave energy to sensible heat when competing with the food product for available microwave energy.

High Power RAT: Each sample evaluated for high power RAT was subjected to an increasing E-field strength using a Magnetron microwave power generator. The input power, reflected power, and transmitted power were measured and the RAT values were reported.

Open Load Abuse: Each sample evaluated for open load abuse characteristics was heated in a microwave oven at 100% power without a food load until equilibrium heating was reached or until a self-sustaining fire occurred. Various microwave ovens were used to conduct the open load abuse testing, as set forth in Table 2.

TABLE 2

| Microwave Oven | Description | Output (W) | Volume (cubic feet) |
|---|---|---|---|
| 1 | Panasonic Commercial Model NE-1757CR | 1600 | 0.6 |
| 2 | Panasonic Inverter Model No. NN-S740WA | 1200 | 1.2 |
| 3 | Orbit/LG Model No. LTS1240TB | 1100 | 1.2 |
| 4 | Emerson Model No. MW9170BC | 1000 | 1.1 |

Image Analysis: Each susceptor structure evaluated was cut into a sample having a size of about 2 in.×4 in. and mounted in a cardboard frame. One at a time, the samples were placed on the auto macro-stage of a Leica QWIN Image Analysis System. The samples were illuminated by four flood lamps that provided incident omni-directional darkfield illumination.

The cracks on the susceptor structures were examined with a macro lens, and Leica DFC 350 camera, sufficient to image a 1 cm wide field-of-view (FOV). Twenty-eight (28) 1 cm fields were scanned using auto-stage motion in a non-adjacent 4×7 matrix, with a stop at each field position for focus, lighting, and threshold adjustments needed to compensate for sample buckling, illumination variability, and background scorching.

The cracks were detected in auto-delineation mode using various steps of binary "open" and "close" operations, combined with image subtraction, to remove noise and the intentionally imparted microwave energy transparent areas (e.g., segmented hexagonal loops and crosses). The image processing and procedures listed above are known to those proficient in the art of image analysis.

Parameters measured were percent area (% A) covered by cracks of all types, shown as a histogram with statistics, standard deviation (SD), crack length (L) presented as a histogram with statistics, and mean crack width (W). The crack length was terminated by the image frame boundary to avoid the need for "tiling" (adjacent filed continuation of elongated features). A randomly acquired FOV image, the last field examined (field no. 28), was taken for each sample (photos not included). No section of a "typical" image was attempted. Additionally, the total crack length within the total area scanned (L/A) was calculated in mm/sq. cm.

EXAMPLES

Numerous samples of microwave energy interactive structures were prepared and evaluated according to the procedures described above, as set forth below.

Example 1

An exemplary susceptor film according to the invention having an optical density of about 0.26 was laminated to paper having a basis weight of about 35 lb/ream. The susceptor film was substantially similar to the structure shown schematically in FIG. 1G, except for variations that will be understood by those in the art. In this example, D1 was about 2 mm, D2 was about 0.5 mm, D2 was about 1.5 mm, D4 was about 0.5 mm, D7 was about 1 mm, D8 was about 2 mm, D9 was about 2 mm, D10 was about 0.5 mm, D11 was about 0.5 mm, D12 was about 10 mm, D13 was about 17.8, D15 was about 0.75 mm, D16 was about 0.75 mm, D17 was about 8.9 mm, and D18 was about 15.4 mm. Six samples were prepared and evaluated for low power RAT. Each sample was tested in the machine direction and the cross machine direction. The results are presented in Table 3.

TABLE 3

| Samples 1-6 | R (%) | A (%) | T (%) | MF (%) |
|---|---|---|---|---|
| Average (%) | 47.3 | 42.4 | 10.3 | 80.6 |
| Standard deviation (%) | 3.6 | 2.4 | 2.1 | 3.1 |
| Maximum (%) | 51 | 84 | 48 | 84 |
| Minimum (%) | 40 | 39 | 8 | 76 |

Samples 1-6 also were subjected to open load testing in a microwave oven. Each sample sustained heating for a period of greater than 120 seconds without creating a fire.

Figure 1H:
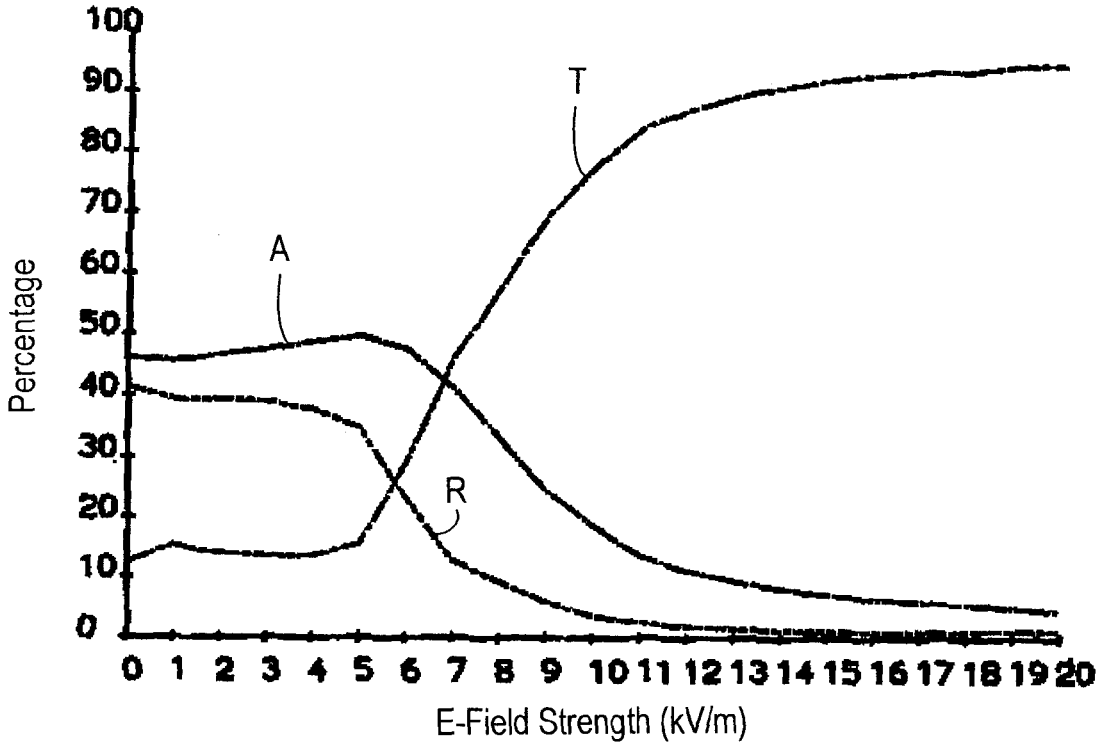
FIGS. 1H-1K present the reflection-absorption-transmission characteristics of the arrangement of FIG. 1G under open load, high power conditions.
Figure 1I:
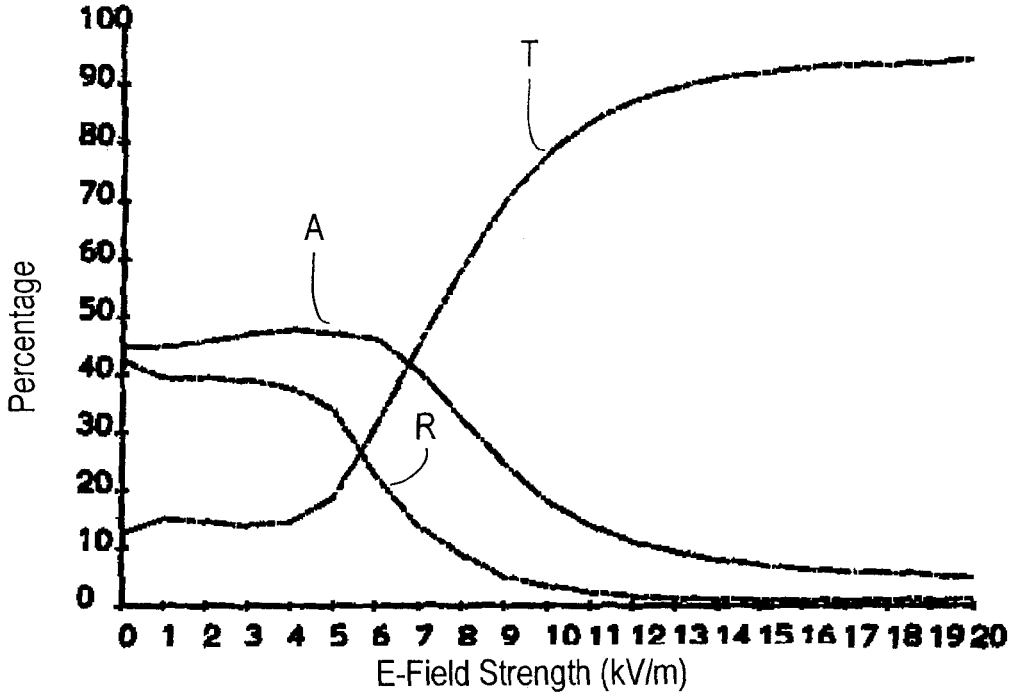
Figure 1J:
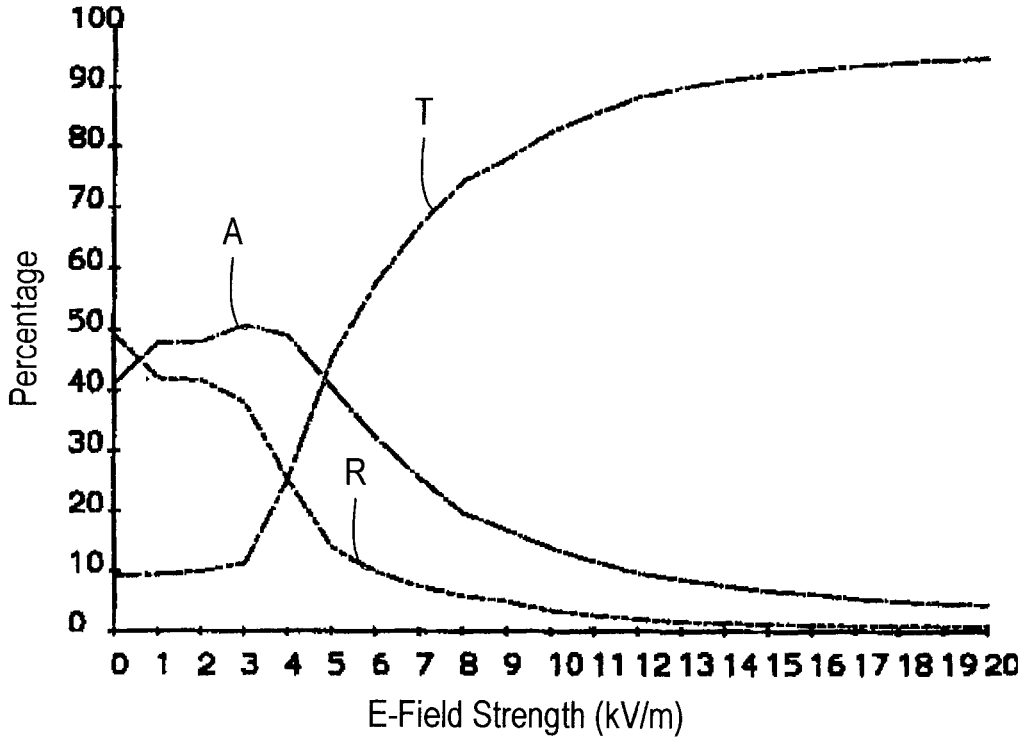
Figure 1K:
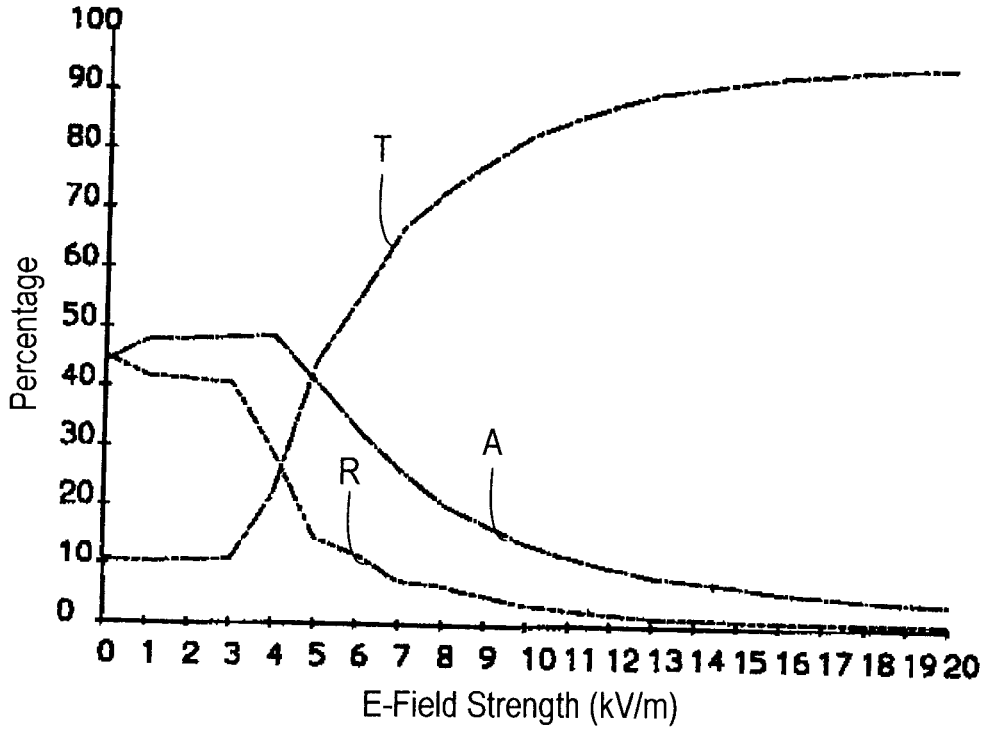

The structure also was evaluated for high power RAT. The results are presented in Table 4 and FIG. 1H (Sample 7, oriented in the machine direction), Table 5 and FIG. 1I (Sample 8, oriented in the cross machine direction), Table 6 and FIG. 1J (Sample 9, oriented in the machine direction), and Table 7 and FIG. 1K (Sample 10, oriented in the cross machine direction).

TABLE 4

| Sample | E-field strength (kV/m) | Incident power (W) | % Reflected | % Absorbed | % Transmitted |
|---|---|---|---|---|---|
| 7 | 0 | — | 41.5 | 46.1 | 12.4 |
| | 1 | 24.2 | 39.3 | 45.5 | 15.3 |
| | 2 | 36.8 | 39.4 | 46.7 | 13.9 |
| | 3 | 53.1 | 39.0 | 47.5 | 13.4 |
| | 4 | 82.8 | 37.7 | 48.8 | 13.5 |
| | 5 | 121.1 | 34.8 | 49.6 | 15.5 |
| | 6 | 155.2 | 23.1 | 47.7 | 29.2 |
| | 7 | 201.4 | 12.7 | 41.1 | 46.2 |
| | 8 | 257.6 | 9.3 | 33.1 | 57.7 |
| | 9 | 319.9 | 5.9 | 24.4 | 69.6 |
| | 10 | 386.4 | 3.7 | 18.7 | 77.6 |
| | 11 | 462.4 | 2.6 | 13.5 | 84.0 |
| | 12 | 548.3 | 1.9 | 11.2 | 86.9 |
| | 13 | 639.7 | 1.5 | 9.4 | 89.1 |
| | 14 | 739.6 | 1.2 | 8.2 | 90.6 |
| | 15 | 847.2 | 1.1 | 7.1 | 91.8 |
| | 16 | 966.1 | 1.0 | 6.5 | 92.5 |
| | 17 | 1086.4 | 1.0 | 5.9 | 93.1 |
| | 18 | 1219.0 | 1.1 | 5.6 | 93.3 |
| | 19 | 1358.3 | 1.2 | 4.9 | 94.0 |
| | 20 | 1506.6 | 1.3 | 4.5 | 94.2 |

TABLE 5

| Sample | E-field strength (kV/m) | Incident power (W) | % Reflected | % Absorbed | % Transmitted |
|---|---|---|---|---|---|
| 8 | 0 | — | 42.5 | 45.0 | 12.5 |
| | 1 | 24.3 | 39.5 | 44.9 | 15.2 |
| | 2 | 36.2 | 39.5 | 45.9 | 14.6 |
| | 3 | 52.2 | 39.1 | 47.1 | 14.0 |
| | 4 | 80.4 | 37.7 | 47.8 | 14.6 |
| | 5 | 115.9 | 33.9 | 47.2 | 18.9 |
| | 6 | 152.8 | 22.5 | 46.3 | 31.1 |
| | 7 | 199.1 | 13.8 | 40.6 | 45.6 |
| | 8 | 253.5 | 9.0 | 32.4 | 58.6 |
| | 9 | 314.8 | 5.1 | 24.7 | 70.1 |
| | 10 | 379.3 | 3.6 | 18.2 | 78.2 |
| | 11 | 456.0 | 2.4 | 14.1 | 83.6 |
| | 12 | 539.5 | 1.7 | 11.2 | 87.1 |
| | 13 | 629.5 | 1.3 | 9.4 | 89.3 |

TABLE 5-continued

| Sample | E-field strength (kV/m) | Incident power (W) | % Reflected | % Absorbed | % Transmitted |
|---|---|---|---|---|---|
| | 14 | 727.8 | 1.1 | 9.0 | 91.0 |
| | 15 | 833.7 | 1.0 | 7.2 | 91.8 |
| | 16 | 948.4 | 0.9 | 6.4 | 92.7 |
| | 17 | 1069.1 | 1.0 | 5.9 | 93.1 |
| | 18 | 1202.3 | 1.0 | 5.8 | 93.1 |
| | 19 | 1339.7 | 1.1 | 5.4 | 93.5 |
| | 20 | 1482.5 | 1.2 | 4.9 | 94.0 |

TABLE 6

| Sample | E-field strength (kV/m) | Incident power (W) | % Reflected | % Absorbed | % Transmitted |
|---|---|---|---|---|---|
| 9 | 0 | — | 49.4 | 41.2 | 9.4 |
| | 1 | 24.0 | 42.1 | 47.9 | 9.6 |
| | 2 | 36.6 | 41.8 | 48.1 | 10.1 |
| | 3 | 51.4 | 38.1 | 50.8 | 11.3 |
| | 4 | 76.6 | 25.3 | 49.1 | 25.6 |
| | 5 | 105.0 | 14.1 | 40.4 | 45.5 |
| | 6 | 142.9 | 10.1 | 32.3 | 57.5 |
| | 7 | 190.1 | 7.5 | 25.6 | 67.0 |
| | 8 | 244.9 | 6.0 | 19.8 | 74.2 |
| | 9 | 306.9 | 5.1 | 17.0 | 78.0 |
| | 10 | 371.5 | 3.6 | 14.0 | 82.4 |
| | 11 | 4447.7 | 2.7 | 11.7 | 85.5 |
| | 12 | 529.7 | 2.1 | 9.8 | 88.1 |
| | 13 | 619.4 | 1.6 | 8.6 | 89.7 |
| | 14 | 716.1 | 1.4 | 7.6 | 91.0 |
| | 15 | 820.4 | 1.2 | 6.8 | 92.0 |
| | 16 | 935.4 | 1.1 | 6.3 | 92.7 |
| | 17 | 1052.0 | 1.0 | 5.5 | 93.5 |
| | 18 | 1180.3 | 0.9 | 5.1 | 94.0 |
| | 19 | 1315.2 | 0.9 | 4.7 | 94.4 |
| | 20 | 1458.8 | 0.9 | 4.5 | 94.6 |

TABLE 7

| Sample | E-field strength (kV/m) | Incident power (W) | % Reflected | % Absorbed | % Transmitted |
|---|---|---|---|---|---|
| 10 | 0 | — | 45.1 | 44.2 | 10.7 |
| | 1 | 24.9 | 41.8 | 47.8 | 10.4 |
| | 2 | 37.3 | 41.3 | 48.0 | 10.7 |
| | 3 | 53.2 | 40.8 | 48.3 | 10.9 |
| | 4 | 79.6 | 29.0 | 48.7 | 22.2 |
| | 5 | 107.4 | 14.6 | 41.0 | 44.3 |
| | 6 | 145.9 | 12.0 | 33.0 | 55.0 |
| | 7 | 193.6 | 7.2 | 26.1 | 66.7 |
| | 8 | 249.5 | 6.5 | 20.4 | 73.1 |
| | 9 | 311.9 | 4.9 | 17.2 | 78.0 |
| | 10 | 377.6 | 3.5 | 13.9 | 82.6 |
| | 11 | 453.9 | 2.7 | 11.8 | 85.5 |
| | 12 | 537.0 | 2.1 | 10.0 | 87.9 |
| | 13 | 626.6 | 1.6 | 8.5 | 89.9 |
| | 14 | 724.4 | 1.4 | 7.6 | 91.0 |
| | 15 | 829.9 | 1.2 | 6.8 | 92.0 |
| | 16 | 944.1 | 1.0 | 5.9 | 93.1 |
| | 17 | 1064.1 | 1.0 | 5.5 | 93.5 |
| | 18 | 1194.0 | 1.0 | 4.8 | 94.2 |
| | 19 | 1330.5 | 0.9 | 4.5 | 94.6 |
| | 20 | 1475.7 | 0.9 | 4.3 | 94.8 |

Example 2

A plain susceptor film having an optical density of about 0.26 was laminated to paper having a basis weight of about 35 lb/ream. Twelve samples were prepared and evaluated to determine the low power RAT characteristics. Each sample was tested in the machine direction and the cross machine direction. The results are presented in Table 8.

TABLE 8

| Samples 11-22 | R (%) | A (%) | T (%) | MF (%) |
|---|---|---|---|---|
| Average (%) | 49 | 42.3 | 8.4 | 83.5 |
| Standard deviation (%) | 1.5 | 1.0 | 0.6 | 0.7 |
| Maximum (%) | 53 | 44 | 9 | 85 |
| Minimum (%) | 46 | 40 | 7 | 83 |

Figure 2A:
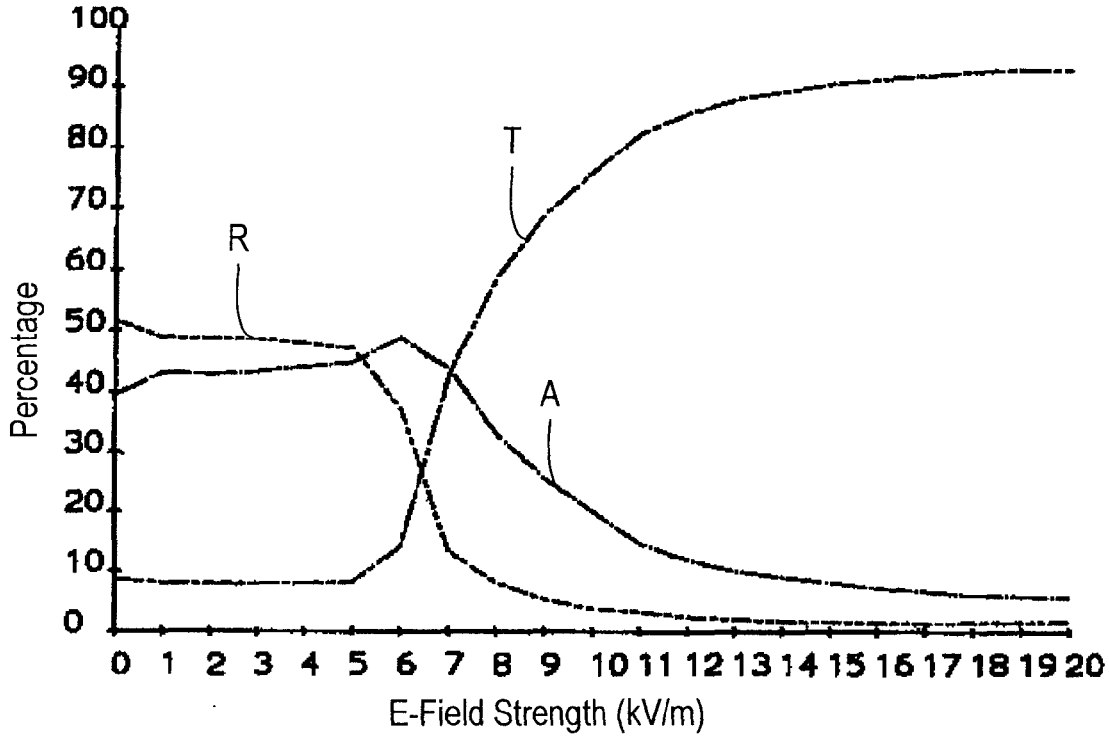
FIGS. 2A and 2B present the reflection-absorption-transmission characteristics of a plain susceptor film joined to paper under open load, high power conditions, for comparative purposes.
Figure 2B:
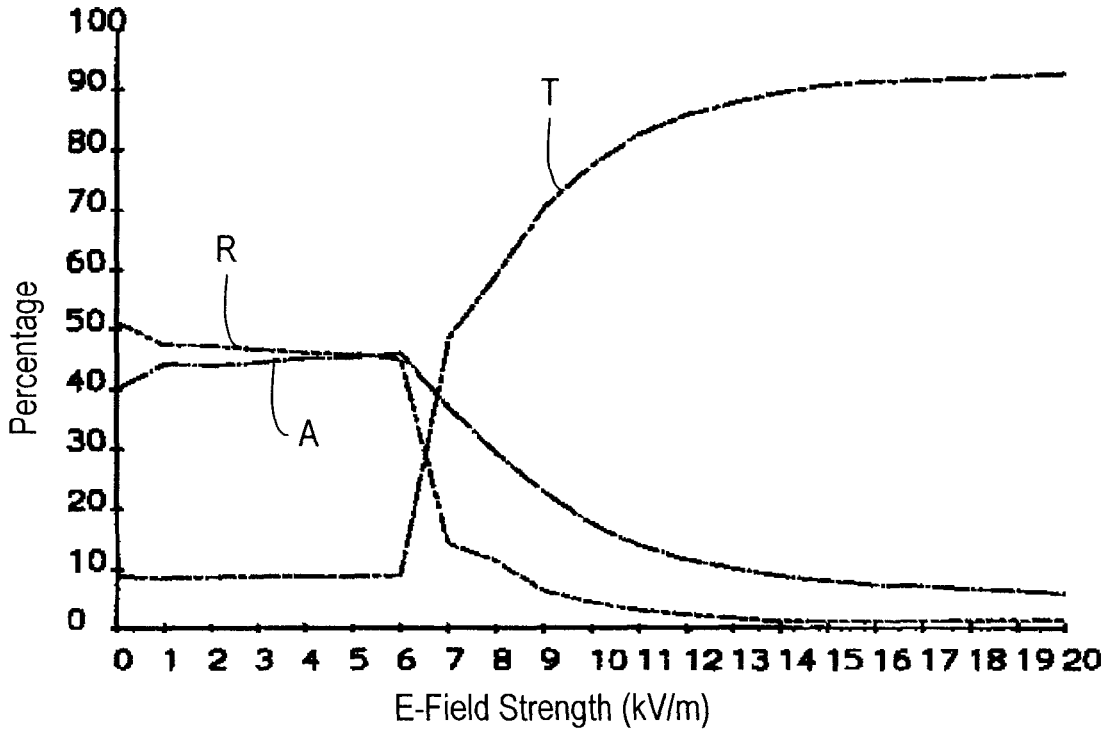

The structure also was evaluated to determine high power RAT characteristics. The results are presented in Table 9 and FIG. 2A (Sample 23, oriented in the machine direction) and Table 10 and FIG. 2B (Sample 24, oriented in the cross machine direction).

TABLE 9

| Sample | E-field strength (kV/m) | Incident power (W) | % Reflected | % Absorbed | % Transmitted |
|---|---|---|---|---|---|
| 23 | 0 | — | 51.8 | 39.6 | 8.6 |
| | 1 | 26.4 | 48.9 | 43.2 | 8.0 |
| | 2 | 39.1 | 48.8 | 43.0 | 7.9 |
| | 3 | 55.7 | 48.7 | 43.4 | 7.9 |
| | 4 | 86.3 | 48.0 | 44.1 | 7.9 |
| | 5 | 130.0 | 47.1 | 44.8 | 8.1 |
| | 6 | 173.8 | 37.1 | 48.9 | 14.0 |
| | 7 | 203.2 | 13.2 | 43.7 | 43.2 |
| | 8 | 258.8 | 8.1 | 33.0 | 58.9 |
| | 9 | 321.4 | 5.3 | 25.5 | 69.2 |
| | 10 | 387.3 | 3.8 | 20.0 | 76.2 |
| | 11 | 464.5 | 3.1 | 14.5 | 82.4 |
| | 12 | 549.5 | 2.4 | 11.9 | 85.7 |
| | 13 | 641.2 | 2.0 | 10.1 | 87.9 |
| | 14 | 739.6 | 1.7 | 9.0 | 89.3 |
| | 15 | 847.2 | 1.5 | 8.0 | 90.6 |
| | 16 | 963.8 | 1.4 | 7.2 | 91.4 |
| | 17 | 1083.9 | 1.3 | 6.6 | 92.0 |
| | 18 | 1216.2 | 1.4 | 6.0 | 92.7 |
| | 19 | 1355.2 | 1.4 | 5.7 | 92.9 |
| | 20 | 1503.1 | 1.5 | 5.6 | 92.9 |

TABLE 10

| Sample | E-field strength (kV/m) | Incident power (W) | % Reflected | % Absorbed | % Transmitted |
|---|---|---|---|---|---|
| 24 | 0 | — | 51.3 | 40.0 | 8.7 |
| | 1 | 24.2 | 47.5 | 44.2 | 8.3 |
| | 2 | 37.1 | 47.4 | 43.9 | 8.6 |
| | 3 | 52.8 | 46.8 | 44.5 | 8.7 |
| | 4 | 81.8 | 46.2 | 45.2 | 8.7 |
| | 5 | 122.7 | 46.0 | 45.3 | 8.7 |
| | 6 | 176.2 | 45.0 | 46.1 | 8.9 |
| | 7 | 196.8 | 14.3 | 36.9 | 48.7 |
| | 8 | 252.3 | 11.5 | 29.4 | 59.2 |
| | 9 | 313.3 | 6.5 | 23.1 | 70.5 |
| | 10 | 379.3 | 4.5 | 17.8 | 77.6 |
| | 11 | 455.0 | 3.1 | 14.1 | 82.8 |
| | 12 | 538.3 | 2.4 | 11.7 | 85.9 |
| | 13 | 628.1 | 1.8 | 10.3 | 87.9 |
| | 14 | 726.1 | 1.3 | 8.9 | 89.7 |
| | 15 | 831.8 | 1.2 | 8.0 | 90.8 |
| | 16 | 948.4 | 1.2 | 7.4 | 91.4 |
| | 17 | 1069.1 | 1.2 | 7.2 | 91.6 |
| | 18 | 1199.5 | 1.3 | 6.7 | 92.0 |
| | 19 | 1336.6 | 1.3 | 6.4 | 92.3 |
| | 20 | 1485.9 | 1.4 | 5.9 | 92.7 |

Example 3

Figure 3A:
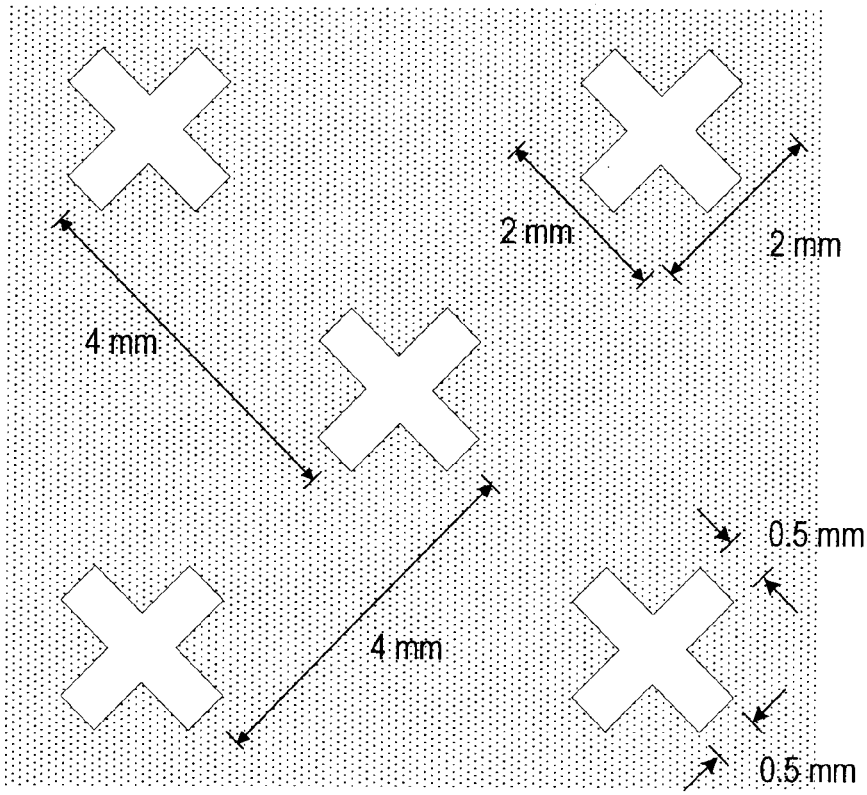
FIG. 3A schematically depicts another exemplary arrangement of microwave energy interactive and transparent elements, with approximate dimensions.

A susceptor film with a simple cross pattern, substantially as shown schematically in FIG. 3A (available commercially from Graphic Packaging International, Inc. (Marietta, Ga.)), was laminated to paper having a basis weight of about 35 lb/ream. Twenty-four samples were prepared and evaluated to determine the low power RAT characteristics of the structure. Each sample was tested in the machine direction and the cross-machine direction. The results are presented in Table 11.

TABLE 11

| Samples 25-48 | R (%) | A (%) | T (%) | MF (%) |
|---|---|---|---|---|
| Average (%) | 44.9 | 45.1 | 9.7 | 82.4 |
| Standard deviation (%) | 3.1 | 2.6 | 2.1 | 3.2 |
| Maximum (%) | 39 | 41 | 7 | 75 |
| Minimum (%) | 51 | 51 | 15 | 87 |

Figure 3B:
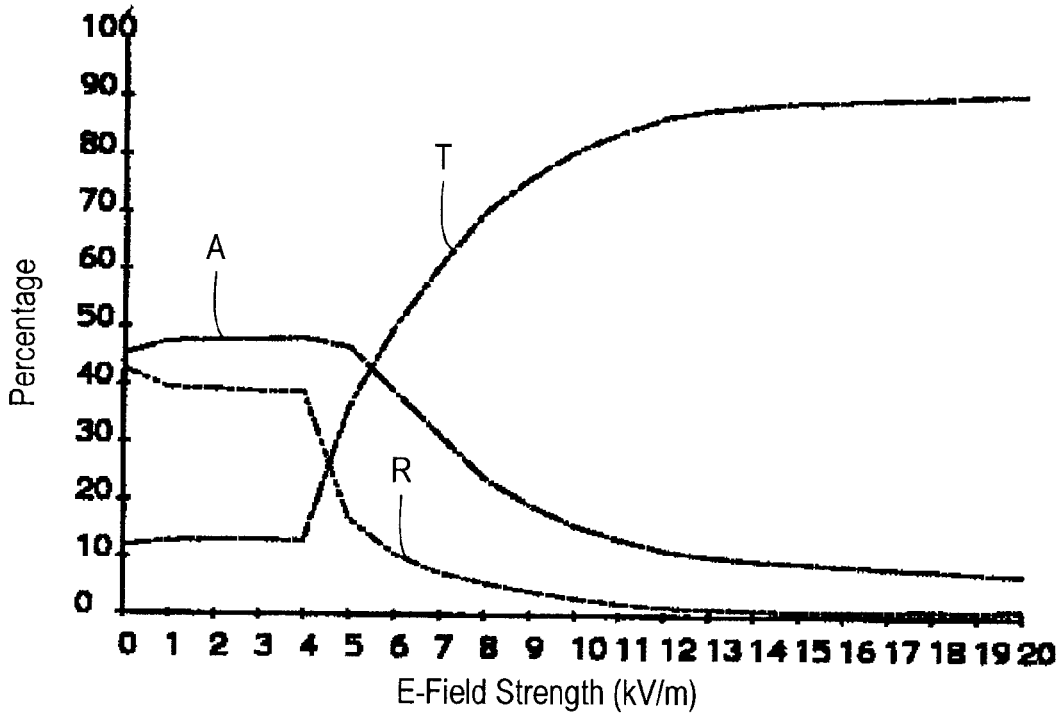
FIGS. 3B-3D present the reflection-absorption-transmission characteristics of the arrangement of FIG. 3A under open load, high power conditions.
Figure 3C:
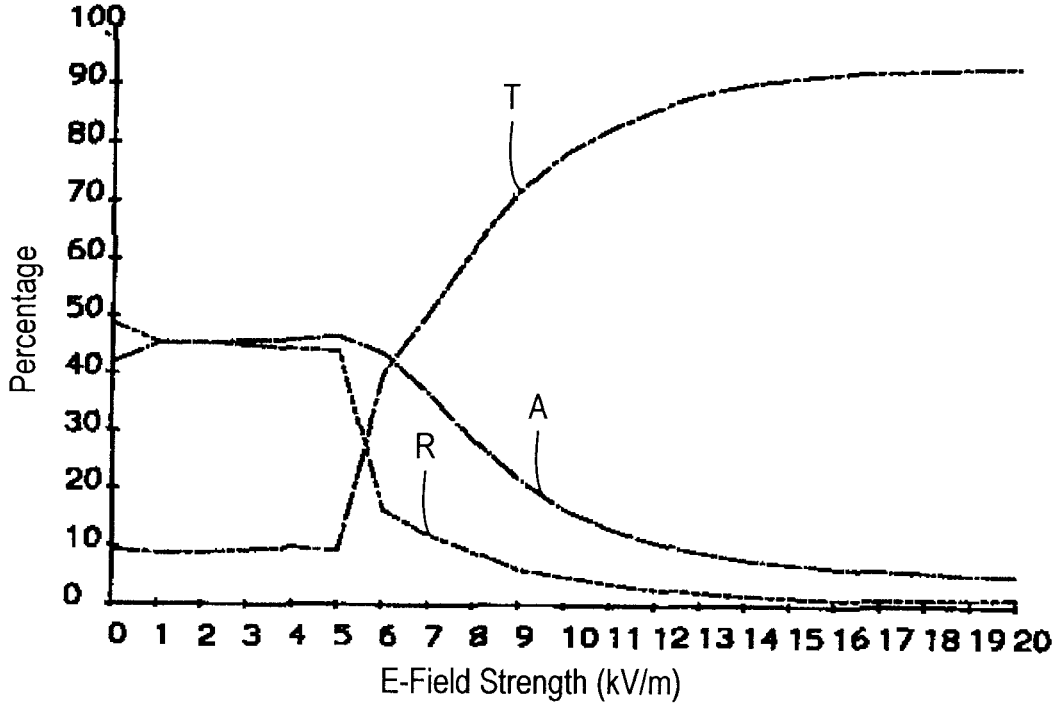
Figure 3D:
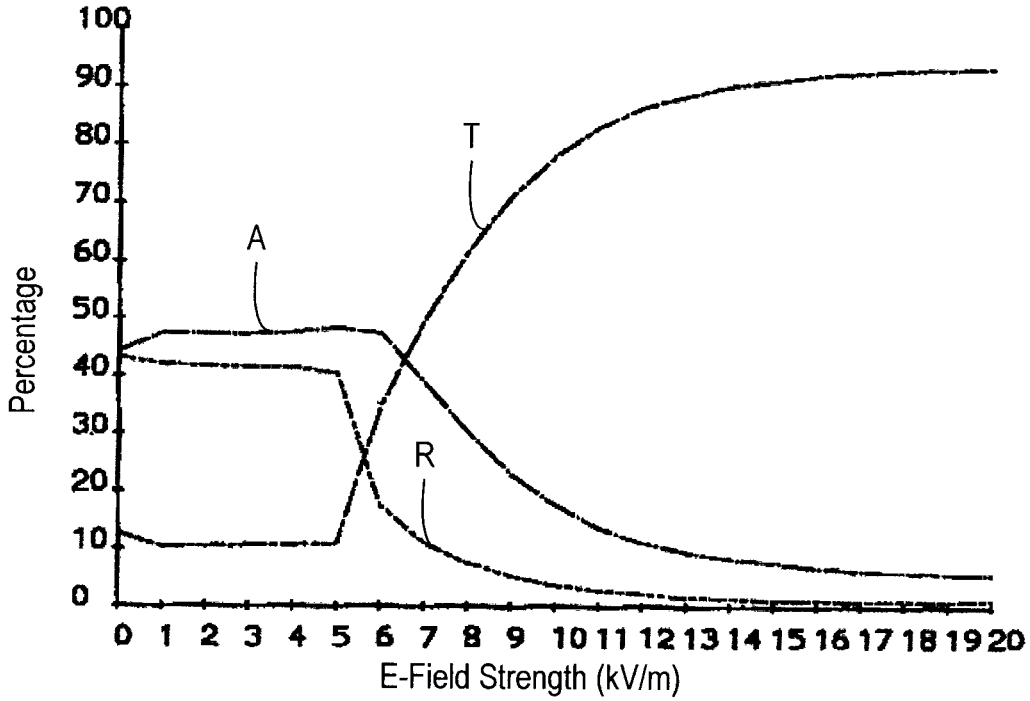

The structure also was subjected to high power RAT testing. The results are presented in Table 12 and FIG. 3B (Sample 49, oriented in the machine direction), Table 13 and FIG. 3C (Sample 50, oriented in the machine direction), and Table 14 and FIG. 3D (Sample 51, oriented in the cross machine direction).

TABLE 12

| Sample | E-field strength (kV/m) | Incident power (W) | % Reflected | % Absorbed | % Transmitted |
|---|---|---|---|---|---|
| 49 | 0 | — | 42.8 | 45.3 | 12.0 |
| | 1 | 25.5 | 39.6 | 47.5 | 12.9 |
| | 2 | 37.9 | 39.3 | 47.8 | 13.2 |
| | 3 | 54.5 | 38.9 | 47.9 | 13.2 |
| | 4 | 85.5 | 38.9 | 48.1 | 13.0 |
| | 5 | 112.2 | 17.0 | 46.6 | 36.3 |
| | 6 | 149.6 | 10.8 | 38.9 | 50.3 |
| | 7 | 199.5 | 7.5 | 31.4 | 61.1 |
| | 8 | 256.4 | 5.8 | 24.1 | 70.2 |
| | 9 | 319.9 | 4.4 | 19.4 | 76.2 |
| | 10 | 387.3 | 3.2 | 15.9 | 80.9 |
| | 11 | 464.5 | 2.4 | 13.5 | 84.1 |
| | 12 | 550.8 | 1.7 | 11.6 | 86.7 |
| | 13 | 642.7 | 1.4 | 10.5 | 88.1 |
| | 14 | 743.0 | 1.2 | 9.9 | 88.9 |
| | 15 | 851.1 | 1.1 | 9.4 | 89.5 |
| | 16 | 970.5 | 1.1 | 9.1 | 89.7 |
| | 17 | 1091.4 | 1.2 | 8.6 | 90.2 |
| | 18 | 1227.4 | 1.3 | 8.4 | 90.4 |
| | 19 | 1364.6 | 1.3 | 7.9 | 90.8 |
| | 20 | 1510.1 | 1.4 | 7.6 | 91.0 |

TABLE 13

| Sample | E-field strength (kV/m) | Incident power (W) | % Reflected | % Absorbed | % Transmitted |
|---|---|---|---|---|---|
| 50 | 0 | — | 48.8 | 41.8 | 9.4 |
| | 1 | 24.4 | 45.5 | 45.1 | 9.0 |
| | 2 | 37.2 | 45.4 | 45.2 | 9.1 |
| | 3 | 52.8 | 44.9 | 45.8 | 9.5 |
| | 4 | 82.2 | 44.3 | 45.9 | 9.9 |
| | 5 | 123.0 | 43.9 | 46.6 | 9.5 |
| | 6 | 147.9 | 16.4 | 43.5 | 40.1 |
| | 7 | 196.3 | 12.2 | 36.7 | 51.0 |
| | 8 | 251.2 | 9.4 | 28.3 | 62.4 |
| | 9 | 312.6 | 6.2 | 21.8 | 71.9 |
| | 10 | 378.4 | 5.0 | 16.6 | 78.4 |
| | 11 | 453.9 | 3.8 | 13.4 | 82.8 |

TABLE 13-continued

| Sample | E-field strength (kV/m) | Incident power (W) | % Reflected | % Absorbed | % Transmitted |
|---|---|---|---|---|---|
| | 12 | 537.0 | 2.9 | 11.0 | 86.1 |
| | 13 | 626.6 | 2.2 | 9.3 | 88.5 |
| | 14 | 724.4 | 1.8 | 8.0 | 90.2 |
| | 15 | 829.9 | 1.5 | 7.3 | 91.2 |
| | 16 | 946.2 | 1.3 | 6.6 | 92.5 |
| | 17 | 1064.1 | 1.3 | 6.3 | 92.1 |
| | 18 | 1196.7 | 1.3 | 6.0 | 92.7 |
| | 19 | 1130.5 | 1.3 | 5.5 | 93.1 |
| | 20 | 1475.7 | 1.4 | 5.3 | 93.3 |

TABLE 14

| Sample | E-field strength (kV/m) | Incident power (W) | % Reflected | % Absorbed | % Transmitted |
|---|---|---|---|---|---|
| 51 | 0 | — | 43.2 | 44.2 | 12.7 |
| | 1 | 24.0 | 42.1 | 47.5 | 10.4 |
| | 2 | 36.1 | 41.8 | 47.4 | 10.5 |
| | 3 | 51.3 | 41.7 | 47.4 | 10.7 |
| | 4 | 80.5 | 41.6 | 47.7 | 10.7 |
| | 5 | 119.7 | 40.6 | 48.5 | 10.9 |
| | 6 | 145.9 | 17.7 | 47.6 | 34.7 |
| | 7 | 191.4 | 11.2 | 39.0 | 49.8 |
| | 8 | 244.9 | 7.7 | 30.5 | 61.8 |
| | 9 | 304.8 | 5.5 | 23.2 | 71.3 |
| | 10 | 369.0 | 3.8 | 17.8 | 78.3 |
| | 11 | 442.6 | 3.0 | 13.8 | 83.2 |
| | 12 | 523.6 | 2.3 | 11.2 | 86.5 |
| | 13 | 612.4 | 1.7 | 9.7 | 88.5 |
| | 14 | 706.3 | 1.4 | 8.4 | 90.2 |
| | 15 | 811.0 | 1.2 | 7.8 | 91.0 |
| | 16 | 922.6 | 1.1 | 6.9 | 92.0 |
| | 17 | 1039.9 | 1.0 | 6.5 | 92.5 |
| | 18 | 1166.8 | 1.0 | 6.1 | 92.9 |
| | 19 | 1300.2 | 1.0 | 5.9 | 93.1 |
| | 20 | 1442.1 | 1.1 | 5.6 | 93.3 |

Example 4

Figure 4A:
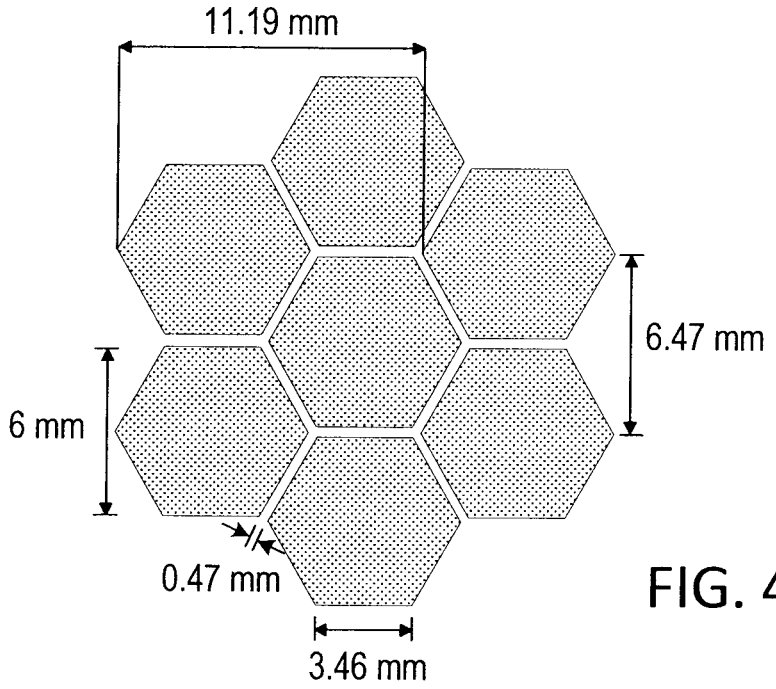
FIG. 4A schematically depicts still another exemplary arrangement of microwave energy interactive and transparent elements, with approximate dimensions.

A susceptor film including a plurality of solid hexagons of microwave energy interactive material, substantially as shown schematically in FIG. 4A, having an optical density of about 0.26, was laminated to paper having a basis weight of about 35 lb/ream. The resulting structure then was evaluated to determine low power RAT characteristics. Each of six samples was tested in the both machine direction and the cross-machine direction. The results are presented in Table 15.

TABLE 15

| Samples 52-57 | R (%) | A (%) | T (%) | MF (%) |
|---|---|---|---|---|
| Average (%) | 28.3 | 34.0 | 37.7 | 47.1 |
| Standard deviation (%) | 4.8 | 8.3 | 5.3 | 9.3 |
| Maximum (%) | 36 | 47 | 47 | 59 |
| Minimum (%) | 18 | 22 | 31 | 34 |

Samples 52-57 also were subjected to open load testing in a microwave ovens. Each of the samples sustained heating for a period of greater than 120 seconds without creating a fire.

Figure 4B:
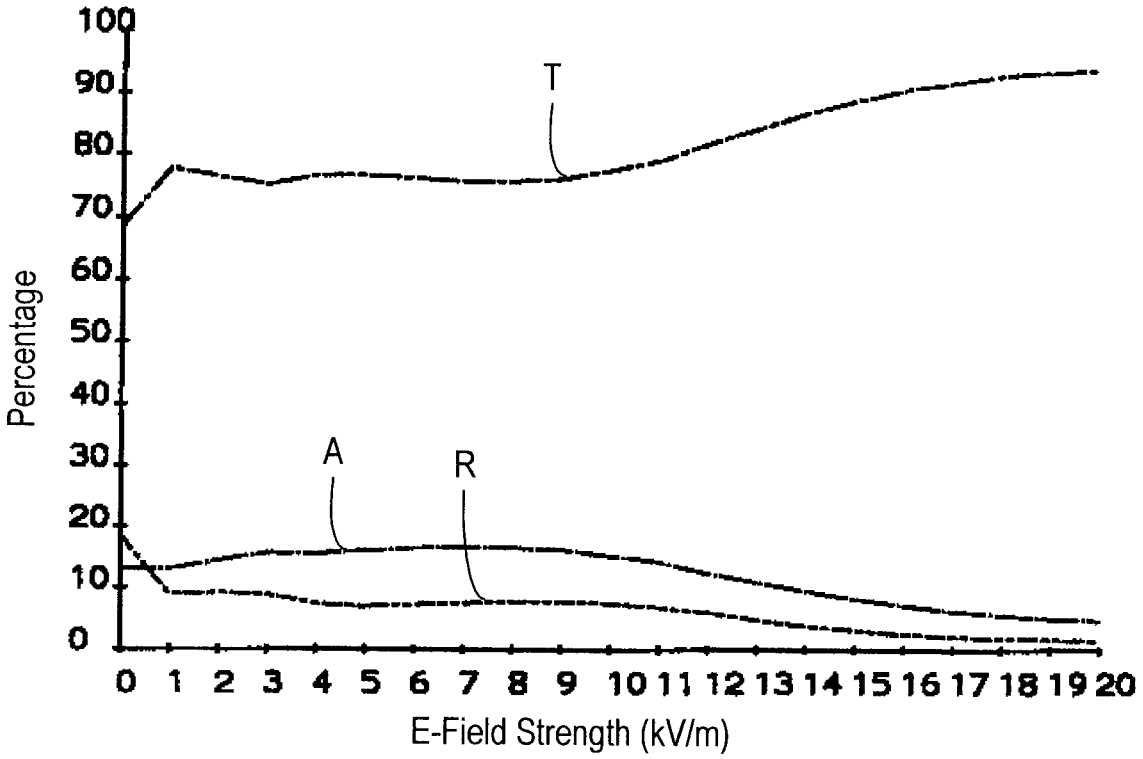
FIGS. 4B and 4C present the reflection-absorption-transmission characteristics of the arrangement of FIG. 4A under open load, high power conditions.
Figure 4C:
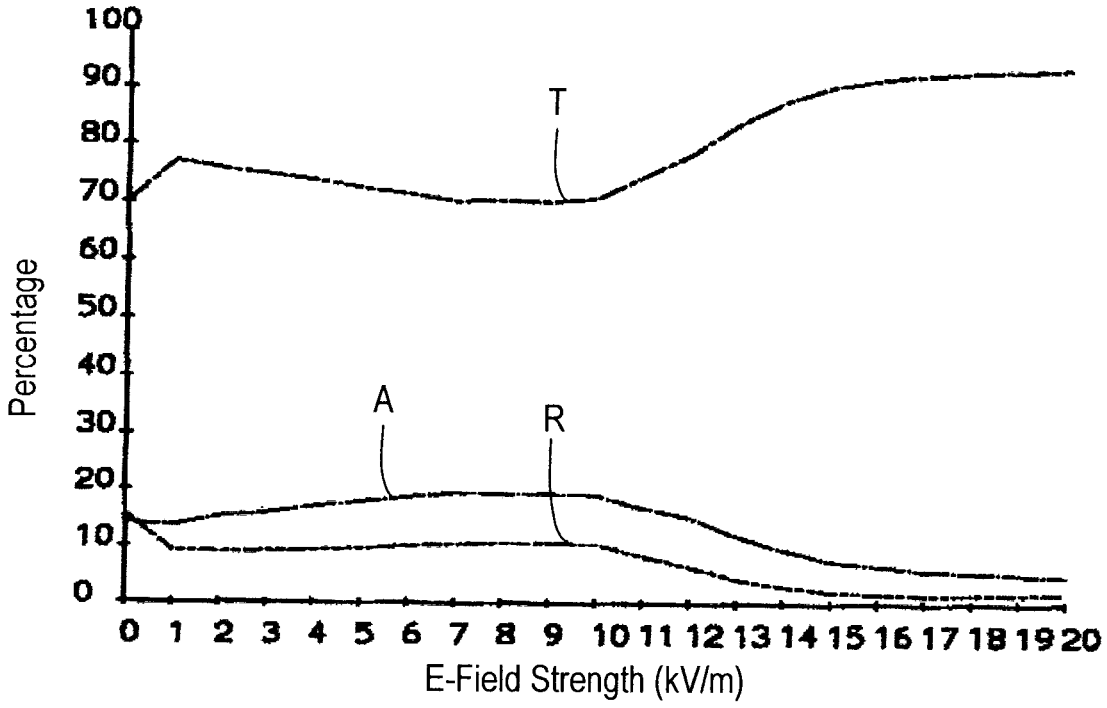

The structure also was evaluated to determine high power RAT characteristics. The results are presented in Table 16 and FIG. 4B (Sample 58, oriented in the machine direction), and Table 17 and FIG. 4C (Sample 59, oriented in the cross machine direction).

TABLE 16

| Sample | E-field strength (kV/m) | Incident power (W) | % Reflected | % Absorbed | % Transmitted |
|---|---|---|---|---|---|
| 58 | 0 | — | 18.5 | 13.1 | 68.4 |
| | 1 | 19.9 | 9.0 | 13.1 | 77.9 |
| | 2 | 32.4 | 9.3 | 14.5 | 76.5 |
| | 3 | 46.9 | 9.0 | 15.8 | 75.3 |
| | 4 | 70.5 | 7.5 | 15.7 | 76.7 |
| | 5 | 100.5 | 7.1 | 16.1 | 76.7 |
| | 6 | 138.7 | 7.3 | 16.5 | 76.2 |
| | 7 | 185.8 | 7.6 | 16.7 | 75.7 |
| | 8 | 241.0 | 7.8 | 16.5 | 75.7 |
| | 9 | 303.4 | 7.8 | 16.2 | 76.0 |
| | 10 | 370.7 | 7.4 | 15.2 | 77.4 |
| | 11 | 446.7 | 6.9 | 14.2 | 48.9 |
| | 12 | 528.4 | 6.0 | 12.4 | 81.7 |
| | 13 | 618.0 | 4.9 | 11.0 | 84.1 |
| | 14 | 714.5 | 3.9 | 9.6 | 86.5 |
| | 15 | 818.5 | 3.2 | 8.3 | 88.5 |
| | 16 | 931.1 | 2.6 | 7.2 | 90.2 |
| | 17 | 1049.5 | 2.2 | 6.3 | 91.4 |
| | 18 | 1177.6 | 1.9 | 5.6 | 92.5 |
| | 19 | 1309.2 | 1.8 | 5.1 | 93.1 |
| | 20 | 1452.1 | 1.7 | 4.8 | 93.5 |

TABLE 17

| Sample | E-field strength (kV/m) | Incident power (W) | % Reflected | % Absorbed | % Transmitted |
|---|---|---|---|---|---|
| 59 | 0 | — | 15.7 | 14.2 | 70.1 |
| | 1 | 20.5 | 9.3 | 13.7 | 77.1 |
| | 2 | 32.2 | 9.0 | 15.2 | 75.8 |
| | 3 | 46.9 | 9.2 | 16.0 | 74.8 |
| | 4 | 70.6 | 9.3 | 17.0 | 73.7 |
| | 5 | 100.7 | 9.6 | 18.0 | 72.4 |
| | 6 | 139.3 | 10.1 | 18.7 | 71.3 |
| | 7 | 188.8 | 10.3 | 19.5 | 70.1 |
| | 8 | 244.3 | 10.5 | 19.3 | 70.2 |
| | 9 | 307.6 | 10.6 | 19.4 | 70.0 |
| | 10 | 375.8 | 10.3 | 19.1 | 70.6 |
| | 11 | 450.8 | 8.4 | 17.0 | 74.6 |
| | 12 | 533.3 | 6.5 | 15.2 | 78.3 |
| | 13 | 619.4 | 4.4 | 12.0 | 83.6 |
| | 14 | 714.5 | 3.0 | 9.5 | 87.5 |
| | 15 | 816.6 | 2.2 | 7.6 | 90.2 |
| | 16 | 931.1 | 1.8 | 6.7 | 91.4 |
| | 17 | 1049.5 | 1.7 | 6.0 | 92.3 |
| | 18 | 1177.6 | 1.7 | 5.6 | 92.7 |
| | 19 | 1312.2 | 1.8 | 5.3 | 92.9 |
| | 20 | 1455.5 | 1.8 | 4.9 | 93.3 |

Example 5

Figure 5A:
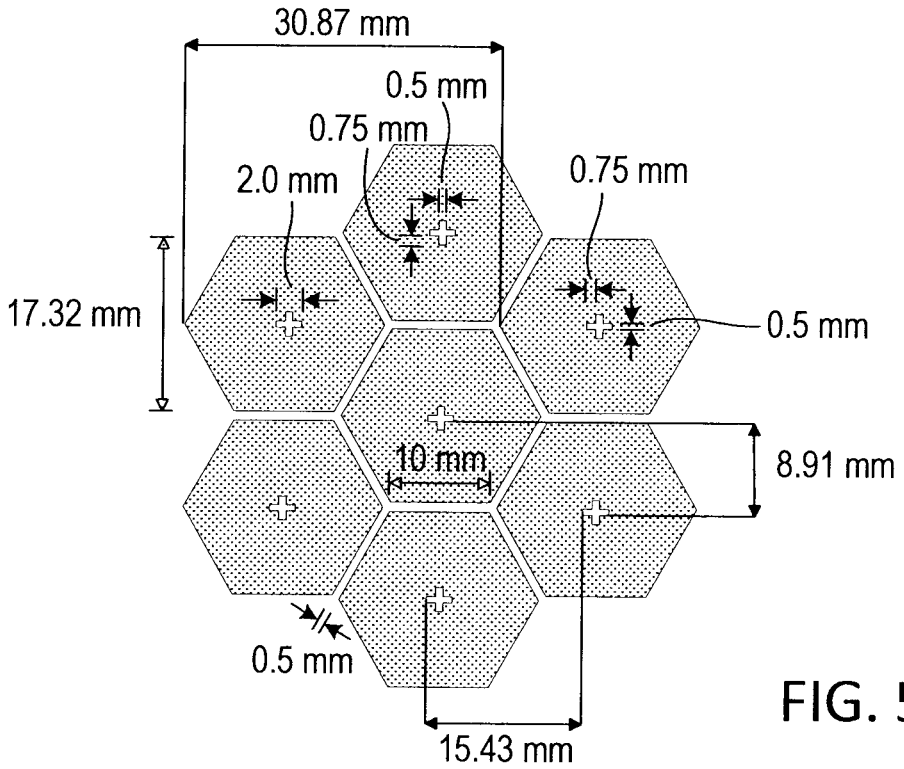
FIG. 5A schematically depicts yet another exemplary arrangement of microwave energy interactive and transparent elements, with approximate dimensions.

A susceptor film including a plurality of solid hexagons with centrally located cross-shaped inactive areas, substantially as shown schematically in FIG. 5A, having an optical density of about 0.26, was laminated to paper having a basis weight of about 35 lb/ream. The resulting structure then was evaluated to determine low power RAT characteristics. Six samples were tested in the machine direction and the cross-machine direction. The results are presented in Table 18.

TABLE 18

| Samples 60-65 | R (%) | A (%) | T (%) | MF (%) |
|---|---|---|---|---|
| Average (%) | 16.3 | 19.9 | 63.8 | 23.6 |
| Standard deviation (%) | 3.2 | 8.2 | 6.8 | 9.2 |
| Maximum (%) | 74 | 41 | 74 | 41 |
| Minimum (%) | 13 | 11 | 52 | 13 |

Samples 60-65 also were subjected to open load testing in a microwave oven. Each of the samples sustained heating for a period of greater than 120 seconds without creating a fire.

Figure 5B:
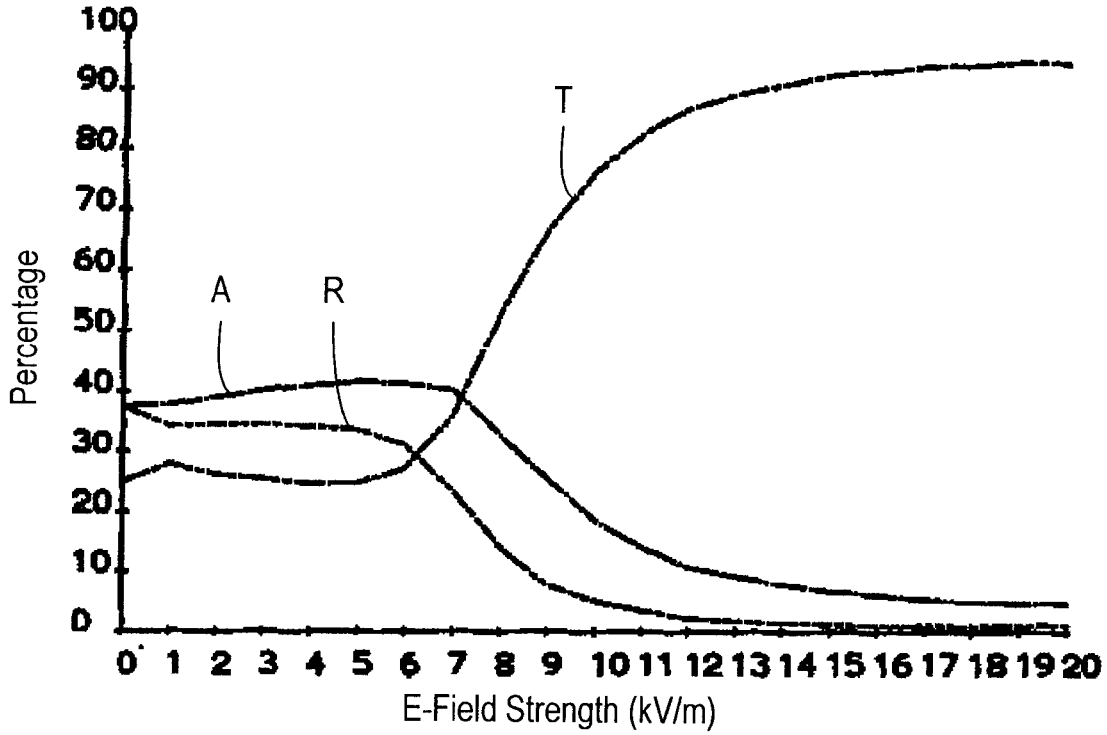
FIGS. 5B and 5C present the reflection-absorption-transmission characteristics of the arrangement of FIG. 5A under open load, high power conditions.
Figure 5C:
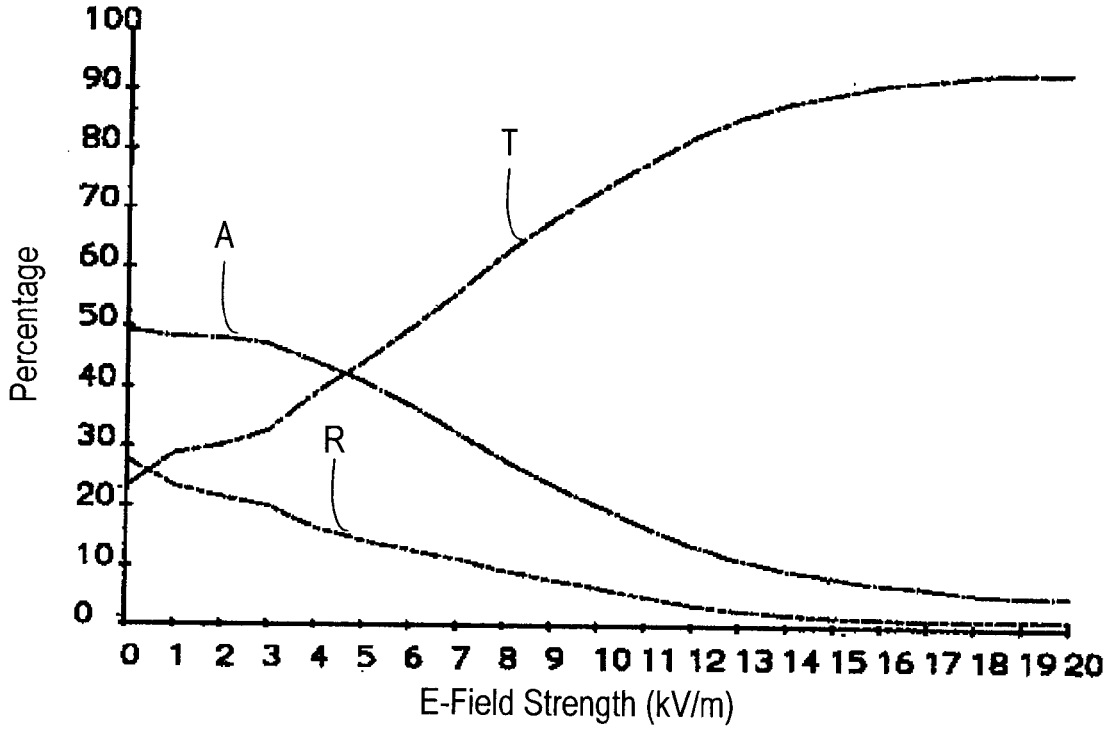

The structure also was evaluated to determine high power RAT characteristics. The results are presented in Table 19 and FIG. 5B (Sample 66, oriented in the machine direction), and Table 20 and FIG. 5C (Sample 67, oriented in the cross machine direction).

TABLE 19

| Sample | E-field strength (kV/m) | Incident power (W) | % Reflected | % Absorbed | % Transmitted |
|---|---|---|---|---|---|
| 66 | 0 | — | 37.4 | 37.6 | 25.0 |
| | 1 | 23.3 | 34.3 | 37.8 | 27.9 |
| | 2 | 35.0 | 34.6 | 39.1 | 26.3 |
| | 3 | 50.2 | 34.5 | 40.2 | 25.5 |
| | 4 | 76.2 | 34.3 | 41.1 | 24.8 |
| | 5 | 111.9 | 33.6 | 41.6 | 24.8 |
| | 6 | 154.5 | 31.3 | 41.4 | 27.3 |
| | 7 | 202.3 | 23.5 | 40.3 | 36.2 |
| | 8 | 252.9 | 14.3 | 32.9 | 52.9 |
| | 9 | 311.9 | 7.8 | 25.6 | 66.7 |
| | 10 | 375.8 | 5.2 | 18.7 | 76.1 |
| | 11 | 450.8 | 3.5 | 14.1 | 82.4 |
| | 12 | 533.3 | 2.4 | 10.9 | 86.7 |
| | 13 | 622.3 | 1.8 | 9.2 | 88.9 |
| | 14 | 719.4 | 1.5 | 7.9 | 90.6 |
| | 15 | 824.1 | 1.3 | 6.7 | 92.1 |
| | 16 | 939.7 | 1.1 | 6.2 | 92.7 |
| | 17 | 1056.8 | 1.1 | 5.3 | 93.5 |
| | 18 | 1185.8 | 1.1 | 5.1 | 93.8 |
| | 19 | 1321.3 | 1.1 | 4.7 | 94.2 |
| | 20 | 1468.9 | 1.2 | 4.8 | 94.0 |

TABLE 20

| Sample | E-field strength (kV/m) | Incident power (W) | % Reflected | % Absorbed | % Transmitted |
|---|---|---|---|---|---|
| 67 | 0 | — | 27.7 | 49.3 | 23.0 |
| | 1 | 21.5 | 23.3 | 48.4 | 28.8 |
| | 2 | 33.8 | 21.6 | 48.2 | 30.2 |
| | 3 | 48.3 | 20.1 | 47.2 | 32.7 |
| | 4 | 73.1 | 16.6 | 44.3 | 39.1 |
| | 5 | 104.5 | 14.5 | 41.1 | 44.2 |
| | 6 | 143.5 | 12.9 | 37.2 | 49.9 |
| | 7 | 191.9 | 11.4 | 32.6 | 56.0 |
| | 8 | 246.6 | 9.5 | 27.9 | 62.5 |
| | 9 | 308.3 | 7.9 | 23.9 | 68.2 |
| | 10 | 375.0 | 6.5 | 20.4 | 73.1 |
| | 11 | 449.8 | 5.1 | 17.0 | 78.0 |
| | 12 | 532.1 | 3.7 | 13.9 | 82.4 |
| | 13 | 620.9 | 2.8 | 11.5 | 85.7 |
| | 14 | 717.8 | 2.1 | 9.8 | 88.1 |
| | 15 | 822.2 | 1.7 | 8.5 | 89.7 |
| | 16 | 935.4 | 1.5 | 7.3 | 91.2 |

TABLE 20-continued

| Sample | E-field strength (kV/m) | Incident power (W) | % Reflected | % Absorbed | % Transmitted |
|---|---|---|---|---|---|
| | 17 | 1054.4 | 1.4 | 6.6 | 92.0 |
| | 18 | 1183.0 | 1.4 | 5.8 | 92.9 |
| | 19 | 1315.2 | 1.4 | 5.3 | 93.3 |
| | 20 | 1462.2 | 1.4 | 5.3 | 93.3 |

Example 6

Various structures were prepared for evaluation and comparison, as set forth in Table 21.

TABLE 21

| Structure | Description |
|---|---|
| Plain paper | Plain susceptor film having an optical density of about 0.26, laminated to paper having a basis weight of about 35 lb/ream (lb/3000 sq. ft.) |
| Plain board | Plain susceptor film having an optical density of about 0.26, laminated to paperboard having a caliper of about 23.5 pt (about 247 lb/ream) |
| Cross paper | Susceptor film with a simple cross pattern, as shown in FIG. 3A, laminated to paper having a basis weight of about 35 lb/ream |
| Cross board | Susceptor film with a simple cross pattern, as shown in FIG. 3A, laminated to paperboard having a caliper of about 14.5 pt (about 152 lb/ream) |
| Hex fuse paper | Exemplary susceptor film according to various aspects of the invention, as shown in FIG. 1G, laminated to paper having a basis weight of about 35 lb/ream |
| Hex fuse board | Exemplary susceptor film according to various aspects of the invention, as shown in FIG. 1G, laminated to paperboard having a caliper of about 23.5 pt (about 247 lb/ream) |

First, several samples were oriented in the machine direction and evaluated to determine low power RAT characteristics and merit factor. Next, several samples, were subjected to open load abuse testing in a 1200 W microwave oven. After the open load testing, several samples again were evaluated for low power RAT characteristics and merit factor to determine the loss in overall efficacy of the susceptor. Finally, several samples were selected for image analysis testing. The results of the various evaluations are presented in Table 22.

In general, when comparing the MF before and after the 10 second open load abuse test, the hex fuse paper outperformed the cross paper susceptor and the plain paper susceptor. Furthermore, viewing the percent crack area and the average crack length per unit area, it is evident that the hex fuse paper was less susceptible to crazing than the cross paper susceptor and the plain paper susceptor.

TABLE 22

| Description | | | Low power RAT - before open load abuse test | | | | Open load | Low power RAT - after open load abuse test | | | | Image analysis | | | | |
|---|---|---|---|---|---|---|---|---|---|---|---|---|---|---|---|---|
| Sample | Susceptor | Paper/board | R (%) | A (%) | T (%) | MF (%) | Time (s) | R (%) | A (%) | T (%) | MF (%) | A (%) | SD (%) | L (mm) | W (mm) | L/A (mm/sq. cm) |
| 68 | Hex fuse | Paper | 49.4 | 41.2 | 9.4 | 81.4 | 10 | 3.5 | 1.5 | 95.1 | 1.5 | 0.38 | 0.23 | 0.32 | 0.048 | 4.6 |
| 69 | Hex fuse | Paper | 45.6 | 44.1 | 10.3 | 81.1 | 10 | 2.3 | −0.1 | 97.7 | −0.1 | 0.26 | 0.24 | 0.24 | 0.039 | 3.0 |
| 70 | Cross | Paper | 38.2 | 48.0 | 13.8 | 77.6 | 10 | 2.2 | −1.0 | 98.9 | −1.1 | 4.2 | 1.0 | 0.32 | 0.052 | 59.0 |
| 71 | Cross | Paper | 34.0 | 49.4 | 16.5 | 75.0 | 10 | 2.8 | −0.3 | 97.5 | −0.3 | 2.8 | 1.1 | 0.33 | 0.051 | 39.8 |
| 72 | Plain | Paper | 51.4 | 35.0 | 13.6 | 72.1 | 10 | 3.7 | 0.3 | 95.9 | 0.3 | — | — | — | — | — |
| 73 | Plain | Paper | 40.5 | 46.7 | 12.8 | 78.5 | 10 | 4.4 | 1.5 | 94.2 | 1.5 | 4.6 | 4.0 | 0.72 | 0.049 | 71.6 |
| 74 | Plain | Paper | 31.3 | 48.1 | 20.6 | 70.0 | 10 | 1.7 | −1.0 | 99.3 | −1.0 | 7.7 | 2.9 | 0.38 | 0.060 | 95.3 |

TABLE 22-continued

| Description | | | Low power RAT - before open load abuse test | | | | Open load | Low power RAT - after open load abuse test | | | | Image analysis | | | | |
|---|---|---|---|---|---|---|---|---|---|---|---|---|---|---|---|---|
| Sample | Susceptor | Paper/ board | R (%) | A (%) | T (%) | MF (%) | Time (s) | R (%) | A (%) | T (%) | MF (%) | A (%) | SD (%) | L (mm) | W (mm) | L/A (mm/sq. cm) |
| 75 | Hex fuse | Paper | 51.8 | 39.6 | 8.6 | 82.1 | 20 | 3.0 | 0.8 | 96.2 | 0.8 | — | — | — | — | — |
| 76 | Hex fuse | Paper | 44.5 | 44.7 | 10.8 | 80.5 | 20 | 2.1 | 0.4 | 97.5 | 0.4 | — | — | — | — | — |
| 77 | Plain/ Hex fuse | Paper/ Paper | 40.0 | 52.1 | 7.9 | 86.8 | 20 | 3.6 | 0.7 | 95.7 | 0.7 | — | — | — | — | — |
| 78 | Hex fuse | Board | 45.3 | 46.4 | 8.3 | 84.8 | 20 | 11.6 | 6.9 | 81.5 | 7.8 | 3.8 | 2.4 | 0.95 | 0.050 | 49.9 |
| 79 | Cross | Paper | 30.5 | 50.2 | 19.2 | 72.3 | 20 | 2.6 | −0.8 | 98.2 | −0.8 | — | — | — | — | — |
| 80 | Cross | Paper | 25.6 | 50.2 | 24.2 | 67.5 | 20 | 1.8 | −0.9 | 99.1 | −0.9 | — | — | — | — | — |
| 81 | Cross | Board | 35.9 | 48.3 | 15.8 | 75.4 | 20 | — | — | — | — | 6.7 | 3.3 | 0.48 | 0.059 | 83.6 |
| 82 | Plain | Paper | 47.4 | 44.4 | 8.2 | 84.4 | 20 | 3.1 | −0.4 | 97.3 | −0.4 | — | — | — | — | — |
| 83 | Plain | Paper | 40.1 | 47.0 | 12.9 | 78.4 | 20 | 2.3 | −0.7 | 98.4 | −0.8 | — | — | — | — | — |
| 84 | Plain | Paper | 48.3 | 42.2 | 9.5 | 81.7 | 20 | 2.2 | −1.2 | 99.1 | −1.3 | — | — | — | — | — |
| 85 | Plain | Board | 48.8 | 41.8 | 9.4 | 81.6 | 20 | 13.9 | 10.9 | 75.2 | 12.7 | 5.4 | 2.5 | 0.55 | 0.044 | 78.8 |

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the invention as set forth in the following claims.

While the present invention is described herein in detail in relation to specific aspects, it is to be understood that this detailed description is only illustrative and exemplary of the present invention and is made merely for purposes of providing a full and enabling disclosure of the present invention and to provide the best mode contemplated by the inventor or inventors of carrying out the invention. The detailed description set forth herein is not intended nor is to be construed to limit the present invention or otherwise to exclude any such other embodiments, adaptations, variations, modifications, and equivalent arrangements of the present invention.

What is claimed is:

1. A microwave energy interactive structure, comprising:

an electrically continuous layer of microwave energy interactive material supported on a microwave energy transparent substrate, the microwave energy interactive material being operative for converting microwave energy into heat; and a plurality of discrete microwave energy transparent segments spaced apart from one another within the layer of microwave energy interactive material, so that each segment is circumscribed by the microwave energy interactive material, the plurality of spaced apart microwave energy transparent segments defining a pattern of interconnected hexagonal loops, wherein a plurality of the interconnected hexagonal loops defines a resonant loop having a total peripheral length approximately equal to the wavelength of microwave energy in an operating microwave oven.

2. The microwave energy interactive structure of claim 1, wherein the total peripheral length of the resonant loop is about 12 cm.

3. The microwave energy interactive structure of claim 1, wherein the total peripheral length of the resonant loop is from about 10 cm to about 12 cm.

4. The microwave energy interactive structure of claim 1, wherein the interconnected hexagonal loops defining the resonant loop are arranged in a clustered configuration.

5. The microwave energy interactive structure of claim 1, wherein the interconnected hexagonal loops defining the resonant loop are arranged in a linear configuration.

6. The microwave energy interactive structure of claim 1, wherein the interconnected hexagonal loops defining the resonant loop comprise three interconnected hexagonal loops.

7. The microwave energy interactive structure of claim 1, wherein the plurality of spaced apart microwave energy transparent segments defining the pattern of interconnected hexagonal loops includes side segments and corner segments.

8. The microwave energy interactive structure of claim 7, wherein the side segments have a substantially rectangular shape.

9. The microwave energy interactive structure of claim 7, wherein the corner segments have a substantially tri-star shape.

10. The microwave energy interactive structure of claim 1, wherein the plurality of microwave energy transparent segments further defines a plurality of cross-shaped elements.

11. The microwave energy interactive structure of claim 10, wherein the cross-shaped elements are each substantially centered within the interconnected hexagonal loops.

12. The microwave energy interactive structure of claim 1, in combination with a food item, wherein the food item has a surface that is desirably at least one of browned and crisped.

13. A microwave energy interactive structure, comprising:

an electrically continuous layer of microwave energy interactive material supported on a microwave energy transparent substrate, the microwave energy interactive material being operative for converting microwave energy into heat; and a plurality of microwave energy transparent areas spaced apart from one another within the layer of microwave energy interactive material, so that each microwave energy transparent area is surrounded by the microwave energy interactive material, the plurality of microwave energy transparent areas defining a pattern of interconnected loops and microwave energy transparent areas disposed within the interconnected loops, wherein a plurality of the interconnected loops define a resonant loop having a total peripheral length approximately equal to the wavelength of microwave energy in an operating microwave oven.

14. The microwave energy interactive structure of claim 13, wherein the total peripheral length of the resonant loop is about 12 cm.

15. The microwave energy interactive structure of claim 13, wherein the total peripheral length of the resonant loop is from about 10 cm to about 12 cm.

16. The microwave energy interactive structure of claim 13, wherein the interconnected loops defining the resonant loop are arranged in a clustered configuration.

17. The microwave energy interactive structure of claim 13, wherein the interconnected loops defining the resonant loop are arranged in a linear configuration.

18. The microwave energy interactive structure of claim 13, wherein the interconnected loops defining the resonant loop comprise three interconnected loops.

19. The microwave energy interactive structure of claim 13, wherein the plurality of microwave energy transparent areas defining the pattern of interconnected loops includes side areas and corner areas.

20. The microwave energy interactive structure of claim 19, wherein the side areas have a substantially rectangular shape.

21. The microwave energy interactive structure of claim 19, wherein the corner areas have a substantially tri-star shape.

22. The microwave energy interactive structure of claim 13, wherein the microwave energy transparent areas disposed within the interconnected loops are cross-shaped.

23. The microwave energy interactive structure of claim 13, in combination with a food item, wherein the food item has a surface that is desirably at least one of browned and crisped.

24. A microwave energy interactive structure, comprising:

an electrically continuous layer of microwave energy interactive material supported on a microwave energy transparent substrate, the microwave energy interactive material being operative for converting microwave energy into heat; and a repeating pattern of microwave energy transparent areas within the layer of conductive material, the repeating pattern of microwave energy transparent areas including interconnected segmented hexagonal loops and cross-shaped elements, wherein the cross-shaped microwave elements are each disposed within a respective one of the interconnected segmented hexagonal loops, wherein the interconnected segmented hexagonal loops each have a first peripheral length, the peripheral length being approximately equal to one-half of an effective wavelength of microwaves in an operating microwave oven, and a plurality of the interconnected segmented hexagonal loops define a resonant loop having a total peripheral length, the total peripheral length being approximately equal to the effective wavelength of microwave energy in the operating microwave oven.

25. The microwave energy interactive structure of claim 24, wherein the first peripheral length is from about 4.8 cm to about 6.0 cm.

26. The microwave energy interactive structure of claim 24, wherein the first peripheral length is from about 4.3 cm to about 5.2 cm.

27. The microwave energy interactive structure of claim 24, wherein the total peripheral length is from about 10 cm to about 12 cm.

28. The microwave energy interactive structure of claim 24, wherein the interconnected segmented hexagonal loops defining the resonant loop are arranged in a clustered configuration.

29. The microwave energy interactive structure of claim 24, wherein the interconnected segmented hexagonal loops defining the resonant loop are arranged in a linear configuration.

30. The microwave energy interactive structure of claim 24, wherein the plurality of the interconnected segmented hexagonal loops defining the resonant loop comprises three interconnected hexagonal loops.

31. The microwave energy interactive structure of claim 24, in combination with a food item, wherein the food item has a surface that is desirably at least one of browned and crisped.

32. A microwave energy interactive structure, comprising:

microwave energy interactive material supported on a microwave energy transparent substrate, the microwave energy interactive material being operative for converting microwave energy into heat; and a plurality of microwave energy transparent segments circumscribed by the microwave energy interactive material, the plurality of spaced apart microwave energy transparent segments defining a pattern of interconnected hexagonal loops, wherein the plurality of spaced apart microwave energy transparent segments defining the pattern of interconnected hexagonal loops includes side segments and corner segments, the corner segments having a substantially tri-star shape, and wherein a plurality of the interconnected hexagonal loops defines a resonant loop having a total peripheral length approximately equal to the wavelength of microwave energy in an operating microwave oven.

33. The microwave energy interactive structure of claim 32, wherein the total peripheral length of the resonant loop is from about 10 cm to about 12 cm.

34. The microwave energy interactive structure of claim 32, wherein the interconnected hexagonal loops defining the resonant loop are arranged in a clustered configuration.

35. The microwave energy interactive structure of claim 32, wherein the interconnected hexagonal loops defining the resonant loop are arranged in a linear configuration.

36. The microwave energy interactive structure of claim 32, wherein the interconnected hexagonal loops defining the resonant loop comprise three interconnected hexagonal loops.

37. The microwave energy interactive structure of claim 32, wherein the side segments have a substantially rectangular shape.

38. The microwave energy interactive structure of claim 32, wherein the plurality of microwave energy transparent segments further defines cross-shaped elements positioned within the interconnected hexagonal loops.

39. The microwave energy interactive structure of claim 32, in combination with a food item, wherein the food item has a surface that is desirably at least one of browned and crisped.

40. A microwave energy interactive structure, comprising:

microwave energy interactive material supported on a microwave energy transparent substrate, the microwave energy interactive material being operative for converting microwave energy into heat; and a plurality of microwave energy transparent areas within the microwave energy interactive material, the plurality of microwave energy transparent areas defining a pattern of interconnected loops and microwave energy transparent areas disposed within the interconnected loops, wherein the plurality of microwave energy transparent areas defining the pattern of interconnected loops include side areas and corner areas, the corner areas having a substantially tri-star shape, and wherein a plurality of the interconnected loops define a resonant loop having a total peripheral length approximately equal to the wavelength of microwave energy in an operating microwave oven.

41. The microwave energy interactive structure of claim 40, wherein the interconnected loops defining the resonant loop are arranged in a clustered configuration.

42. The microwave energy interactive structure of claim 40, wherein the interconnected loops defining the resonant loop are arranged in a linear configuration.

43. The microwave energy interactive structure of claim 40, wherein the interconnected loops defining the resonant loop comprise three interconnected loops, and the total peripheral length of the resonant loop is from about 10 cm to about 12 cm.

44. The microwave energy interactive structure of claim 40, wherein the side areas have a substantially rectangular shape, and the microwave energy transparent areas disposed within the interconnected loops have a cross shape.

45. The microwave energy interactive structure of claim 40, in combination with a food item, wherein the food item has a surface that is desirably at least one of browned and crisped.

* * * * *